US007112392B2

(12) United States Patent
Shimada et al.

(10) Patent No.: US 7,112,392 B2
(45) Date of Patent: Sep. 26, 2006

(54) ELECTROPHOTOGRAPHIC PHOTORECEPTOR, AND IMAGE FORMING METHOD, IMAGE FORMING APPARATUS AND PROCESS CARTRIDGE FOR IMAGE FORMING APPARATUS USING THE ELECTROPHOTOGRAPHIC PHOTORECEPTOR

(75) Inventors: Tomoyuki Shimada, Shizuoka-ken (JP); Takaaki Ikegami, Shizuoka-ken (JP); Yasuo Suzuki, Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 355 days.

(21) Appl. No.: 10/784,872

(22) Filed: Feb. 24, 2004

(65) Prior Publication Data

US 2004/0170911 A1 Sep. 2, 2004

(30) Foreign Application Priority Data

Feb. 26, 2003 (JP) ..... 2003-049975

(51) Int. Cl.
*G03G 5/06* (2006.01)

(52) U.S. Cl. ..... 430/74; 430/73; 430/77; 430/79; 430/126; 399/159

(58) Field of Classification Search ..... 430/74, 430/73, 77, 79, 126; 399/159
See application file for complete search history.

(56) References Cited

U.S. PATENT DOCUMENTS

| | | | |
|---|---|---|---|
| 5,260,156 | A | 11/1993 | Hashimoto et al. |
| 6,136,483 | A | 10/2000 | Suzuki et al. |
| 6,313,288 | B1 | 11/2001 | Shimada et al. |
| 6,492,079 | B1 | 12/2002 | Shimada et al. |
| 6,524,761 | B1 | 2/2003 | Shimada et al. |
| 6,544,701 | B1 | 4/2003 | Tadokoro et al. |
| 6,548,216 | B1 | 4/2003 | Kawamura et al. |
| 6,596,449 | B1 | 7/2003 | Shimada et al. |
| 2004/0170911 | A1 | 9/2004 | Shimada et al. |

FOREIGN PATENT DOCUMENTS

| | | |
|---|---|---|
| JP | 60-196768 | 10/1985 |
| JP | 03-096961 | 4/1991 |
| JP | 2000-231204 | 8/2000 |

OTHER PUBLICATIONS

U.S. Appl. No. 11/229,749, filed Sep. 20, 2005, Ohshima et al.

*Primary Examiner*—Mark A. Chapman
(74) *Attorney, Agent, or Firm*—Oblon, Spivak, McClelland, Maier & Neustadt, P.C.

(57) ABSTRACT

An electrophotographic photoreceptor including an electroconductive substrate and a photosensitive layer on the electroconductive substrate, wherein the photosensitive layer includes at least a compound having a substituted or unsubstituted alkylamino group and a charge transport material, and wherein an oxidation potential (Eox1) of the substituted or unsubstituted alkylamino group and an oxidation potential (Eox2) of the charge transport material satisfy the following relationship (I):

$$Eox1-Eox2 \geqq -0.2. \quad (I)$$

10 Claims, 11 Drawing Sheets

ELECTROPHOTOGRAPHIC PHOTORECEPTOR, AND IMAGE FORMING METHOD, IMAGE FORMING APPARATUS AND PROCESS CARTRIDGE FOR IMAGE FORMING APPARATUS USING THE ELECTROPHOTOGRAPHIC PHOTORECEPTOR

BACKGROUND OF THE INVENTION

1. Field of the Invention

The present invention relates to an electrophotographic photoreceptor, and an image forming method, an image forming apparatus and process cartridge for image forming apparatus using the electrophotographic photoreceptor.

2. Discussion of the Background

Recently, information-processing systems using an electrophotographic method are making a remarkable progress. In particular, laser printers and digital copiers which record data with light by changing the data into digital signals make remarkable improvements in their printing qualities and reliabilities. Further, technologies used in these printers and copiers are applied to laser printers and digital copiers capable of printing full-color images with high-speed printing technologies. Because of these reasons, photoreceptors are required both to produce high-quality images and to have high durability.

Photoreceptors using organic photosensitive materials are widely used for these laser printers and digital copiers due to their cost, productivity and non-polluting properties. The organic photoreceptors are generally classified to a single-layered type and a functionally-separated type. The first practical organic photoreceptor, i.e., PVK-TNF charge transfer complex photoreceptor was the former single-layered type. In 1968, Mr. Hayashi and Mr. Regensburger independently invented PVK/a-Se multi-layered photoreceptor. In 1977, Mr. Melz, and in 1978, Mr. Schlosser disclosed a multi-layered photoreceptor whose photosensitive layers are all formed from organic materials, i.e. , an organic-pigment dispersed layer and an organic low-molecular-weight material dispersed polymer layer. These are called as functionally-separated photoreceptors because of having a charge generation layer (CGL) generating a charge by absorbing light and a charge transport layer (CTL) transporting the charge and neutralizing the charge on a surface of the photoreceptor. The multi-layered photoreceptor has much more improved sensitivity and durability than the single-layered photoreceptor. In addition, since materials can be separately selected for a charge generation material (CGM) and a charge transport material (CTM), a choice range of the materials is largely expanded. Because of these reasons, the multi-layered photoreceptor is now prevailing in the market.

A mechanism to form an electrostatic latent image in the multi-layered photoreceptor is as follows:

the photoreceptor is charged and irradiated with light; the light passes through the CTL and is absorbed by the CGM in the CGL to generate a charge; the charge is injected into the CTL at an interface of the CGL and the CTL; and the charge moves in the CTL by an electric field and neutralizes the charge on the surface of the photoreceptor to form an electrostatic latent image.

However, the photosensitive layers of the organic photoreceptor are easily abraded due to repeated use, and therefore potential and photosensitivity of the photoreceptor tend to deteriorate, resulting in background fouling due to a scratch on the surface thereof and deterioration of density and quality of the resultant images. Therefore, abrasion resistance of the organic photoreceptor has been an important subject. Further, recently, in accordance with speeding up of the printing speed and downsizing of an image forming apparatus, the photoreceptor has to have a smaller diameter, and durability thereof becomes a more important subject.

As a method of improving the abrasion resistance of the photoreceptor, methods of imparting lubricity to the photosensitive layer, hardening the photosensitive layer, including a filler therein and using a high-molecular-weight CTM instead of a low-molecular-weight CTM are widely known. However, another problem occurs when these methods are used to prevent the abrasion of the photoreceptor. Namely, an oxidized gas such as ozone and NOx arising due to use conditions or environment, adheres to the surface of the photosensitive layer and decreases the surface resistance thereof, resulting in a problem such as blurring of the resultant images. So far, such a problem has been avoided to some extent because the material causing the blurred images are gradually scraped off in accordance with the abrasion of the photosensitive layer. However, in order to comply with the above-mentioned recent demand for higher sensitivity and durability of the photoreceptor, a new technique has to be imparted thereto. In order to decrease an influence of the material causing the blurred images, there is a method of equipping the photoreceptor with a heater, which is a large drawback for downsizing the apparatus and decreasing the electric power consumption. In addition, a method of including an additive such as an antioxidant in the photosensitive layer is effective, but since a simple additive does not have photoconductivity, including much amount thereof in the photosensitive layer causes problems such as deterioration of the sensitivity and increase of residual potential of the resultant photoreceptor.

As mentioned above, the electrophotographic photoreceptor having less abrasion by being imparted with abrasion resistance or a process design around thereof inevitably produces blurred and low-resolution images, and it is difficult to have both of high durability and high quality of the resultant images. This is because high surface resistance of the photosensitive layer is preferable to prevent the blurred images and low surface resistance thereof is preferable to prevent the increase of residual potential.

Japanese Laid-Open Patent Publication No. 2000-231204 or 2002-313111 discloses a method of including at least a compound having a dialkylamino group in a photosensitive layer to solve the above-mentioned problem such as blurring of the resultant images due to a blur generating material such as an oxidizing gas. The reason why the compound is effective for maintaining quality of the resultant images after repeated use is not clarified at this time. However, it is supposed that the dialkylamino group having a strong basic neutralizes the oxidizing gas which is considered to cause the blurred images. However, the compound has an effect on image quality after the repeated use, but the resultant photoreceptor does not have high sensitivity and cannot comply with high speed printing because of having a low charge transportability. Therefore, an addition amount thereof has a limit, and a method of combining the compound with a CTM to increase sensitivity and repeated use stability of the resultant photoreceptor is disclosed therein.

On the other hand, it is described that a stilbene compound having a dialkylamino group disclosed in Japanese Laid-Open Patent Publication No. 60-196768 and Japanese Patent No. 2884353 has an effect on the blurred images due to the oxidizing gas on page 37 of Konica Technical Report Vol. 13 written by Itami, etc. and published in 2000. However, since the compound has a substituted dialkylamino group having a strong mesomeric effect (+M effect) at a resonance portion in its triarylamine structure, which is a charge transport site, total ionization potential is extremely small. Therefore, the compound has a critical defect of being quite difficult to practically use because charge retainability of a photosensitive layer in which the compound is used alone as a CTM largely deteriorates from the beginning or after repeated use. In addition, even when the above-mentioned stilbene compound is used together with other CTMs as it is in the present invention, the compound has a considerably smaller ionization potential than the other CTMs and becomes a trap site against a charge transport, and therefore, the resultant photoreceptor has quite a low sensitivity and a large residual potential.

Because of these reasons, a need exists for an electrophotographic photoreceptor having high durability against repeated use for a long time, preventing deterioration of image density and blurred images and stably producing quality images.

SUMMARY OF THE INVENTION

Accordingly, an object of the present invention is to provide an electrophotographic photoreceptor having high durability against repeated use for a long time, preventing deterioration of image density and blurred images and stably producing high-quality images.

Another object of the present invention is to provide an image forming method, an image forming apparatus and a process cartridge using the photoreceptor, in which the photoreceptor need not be exchanged, which enables downsizing the apparatus in accordance with the high-speed printing or smaller diameter of the photoreceptor, and which stably produce high-quality images even after repeated use for a long time.

Briefly these objects and other objects of the present invention as hereinafter will become more readily apparent can be attained by an electrophotographic photoreceptor including an electroconductive substrate and a photosensitive layer on the electroconductive substrate, wherein the photosensitive layer includes at least a compound having a substituted or unsubstituted alkylamino group and a charge transport material, and wherein an oxidation potential (Eox1) of the substituted or unsubstituted alkylamino group and an oxidation potential (Eox2) of the charge transport material satisfy the following relationship (I):

$$Eox1-Eox2 \geqq -0.2 \quad (I)$$

The charge transport material is preferably a stilbene compound having the following formula (1):

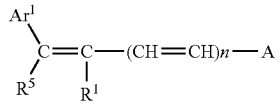

(1)

wherein n is 0 or 1; $R^1$ represents a hydrogen atom, an alkyl group or a substituted or unsubstituted phenyl group; $Ar^1$ represents a substituted or unsubstituted aryl group; $R^5$ represents an alkyl group having 1 to 4 carbon atoms or a substituted or unsubstituted aryl group; and A represents a 9-anthryl group, a substituted or unsubstituted carbazolyl group or a group having the following formula (4) or (5):

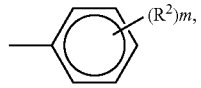

(4)

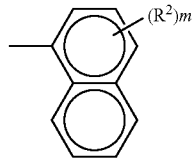

(5)

wherein $R^2$ represents a hydrogen atom, an alkyl group, an alkoxy group, a halogen atom or a group having the following formula (6); and m is an integer of from 1 to 3;

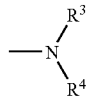

(6)

wherein $R^3$ and $R^4$ independently represent a substituted or unsubstituted aromatic ring group, and may form a ring, and wherein $R^2$ may be the same or different from each other when m is not less than 2, and A and $R^1$ may form a ring together when n is 0.

Further, the charge transport material is preferably a hydrazone compound having the following formula (2):

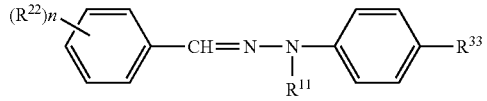

(2)

wherein the $R^{11}$ represents an alkyl group, a benzyl group, a phenyl group or a naphtyl group; $R^{22}$ represents a hydrogen atom, an alkyl group having 1 to 3 carbon atoms, an alkoxy group having 1 to 3 carbon atoms, a dialkylamino group, a diaralkylamino group or a substituted or unsubstituted diarylamino group; n represents integers of from 1 to 4 and $R^{22}$ is optionally the same or different from each other when n is not less than 2; and $R^{33}$ represents a hydrogen atom or a methoxy group.

Furthermore, the charge transport polymer material is preferably a charge transport polymer material having the following formula (3):

(3)

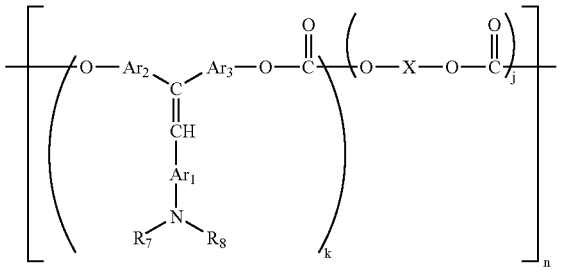

wherein $R^7$ and $R^8$ independently represent a substituted or unsubstituted aromatic ring group; $Ar^1$, $Ar^2$ and $Ar^3$ independently represent an aromatic ring group; k is a number of from 0.1 to 1.0 and j is a number of from 0 to 0.9; n represents a repeating number and is an integer of from 5 to 5,000; and X represents a divalent aliphatic group, a divalent alicyclic group or a divalent group having the following formula (7):

(7)

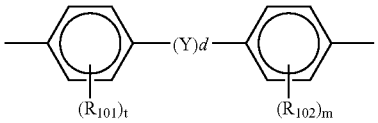

wherein, $R^{101}$ and $R^{102}$ independently represent a substituted or unsubstituted alkyl group, a substituted or unsubstituted aryl group, or a halogen atom; t and m independently represent 0 or an integer of from 1 to 4; d is 0 or 1; and Y represents a linear alkylene group, a branched alkylene group, a cyclic alkylene group, —O—, —S—, —SO—, —$SO_2$—, —CO—, —CO—O—Z—O—CO— (Z represents a divalent aliphatic group), or a group having the following formula (8):

(8)

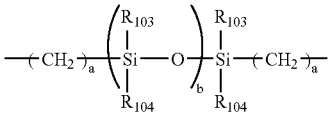

wherein, a is an integer of from 1 to 20; b is an integer of from 1 to 2,000; and $R^{103}$ and $R^{104}$ independently represent a substituted or unsubstituted alkyl group, or a substituted or unsubstituted aryl group, and wherein $R^{101}$, $R^{102}$, $R^{103}$ and $R^{104}$ may be the same or different from the others.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
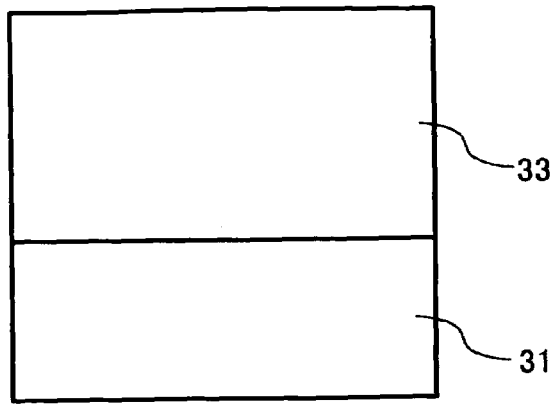
FIG. 1 is a cross-sectional view of an embodiment of the photosensitive layer of the electrophotographic photoreceptor of the present invention.

Generally, the present invention provides an electrophotographic photoreceptor having high durability against repeated use for a long time, preventing deterioration of image density and blurred images and stably producing quality images.

The electrophotographic photoreceptor of the present invention includes an electroconductive substrate and a photosensitive layer on the electroconductive substrate, wherein the photosensitive layer includes at least a compound having a substituted or unsubstituted alkylamino group and a charge transport material, and wherein an oxidation potential (Eox1) of the substituted or unsubstituted alkylamino group and an oxidation potential (Eox2) of the charge transport material satisfy the following relationship (I):

$$Eox1-Eox2 \geqq -0.2 \quad (I)$$

The electrophotographic photoreceptor including a compound having an alkylamino group which is mixed with a CTM of the present invention has a high sensitivity and a high durability, and stably produces high-quality images even after repeated use when the compound having an alkylamino group has an ionization potential not less than that of CTM by a certain level. Namely, as mentioned above, as the alkylamino group is a substituent having a strong mesomeric effect (+M effect), a total ionization potential of the compound becomes extremely small when the substituent is substituted at a resonance portion thereof. When the compound having an alkylamino group has considerably a smaller ionization potential than that of the CTM, it becomes a hole trap site against the charge transport, and therefore the resultant electrophotographic photoreceptor has quite a low sensitivity and a large residual potential. When the compound having an alkylamino group has an ionization potential not less than that of CTM by a certain level, the resultant electrophotographic photoreceptor has a high sensitivity and a high durability, and stably produces high-quality images even after repeated use.

Specific examples of the compound having an alkylamino group include compounds having the following formulae (9) to (35):

(9)

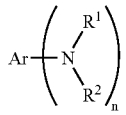

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; n represents an integer of from 1 to 4; and Ar represents a substituted or unsubstituted aromatic ring group;

(10)

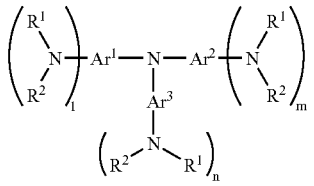

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; l, m and n independently represent 0 or an integer of from 1 to 3, and are not 0 at the same time; $Ar^1$, $Ar^2$ and $Ar^3$ independently represent a substituted or unsubstituted aromatic ring group; and $Ar^1$ and $Ar^2$, $Ar^2$ and $Ar^3$ or $Ar^3$ and $Ar^1$ may independently form a heterocyclic group including a nitrogen atom together;

(11)

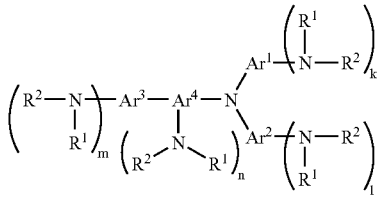

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; k, l, m and n independently represent 0 or an integer of from 1 to 3, and are not 0 at the same time; $Ar^1$, $Ar^2$, $Ar^3$ and $Ar^4$ independently represent a substituted or unsubstituted aromatic ring group; and $Ar^1$ and $Ar^2$, $Ar^1$ and $Ar^4$ or $Ar^3$ and $Ar^4$ may independently form a ring together;

(12)

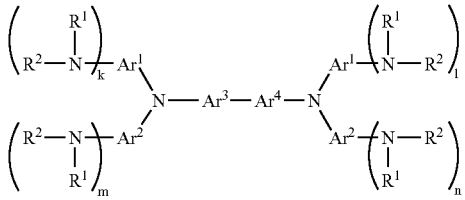

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; k, l, m and n independently represent 0 or an integer of from 1 to 3, and are not 0 at the same time; $Ar^1$, $Ar^2$, $Ar^3$ and $Ar^4$ independently represent a substituted or unsubstituted aromatic ring group; and $Ar^1$ and $Ar^2$, $Ar^1$ and $Ar^3$ or $Ar^3$ and $Ar^4$ may independently form a ring together;

(13)

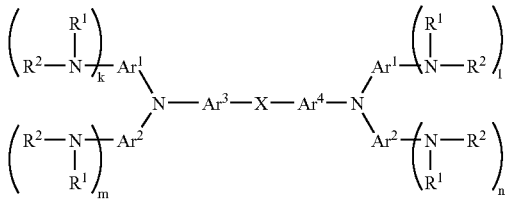

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; k, l, m and n independently represent 0 or an integer of from 1 to 3, and are not 0 at the same time; $Ar^1$, $Ar^2$, $Ar^3$ and $Ar^4$ independently represent a substituted or unsubstituted aromatic ring group; $Ar^1$ and $Ar^2$, $Ar^1$ and $Ar^3$ or $Ar^1$ and $Ar^4$ may independently form a ring together; and X represents a methylene group, a cyclohexylidine group, an oxy atom or a sulfur atom;

(14)

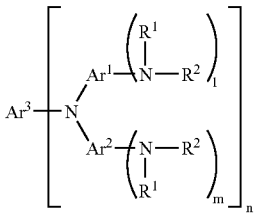

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; 1 and m independently represent 0 or an integer of from 1 to 3, and are not 0 at the same time; $Ar^1$, $Ar^2$ and $Ar^3$ independently represent a substituted or unsubstituted aromatic ring group; $Ar^1$ and $Ar^2$ or $Ar^1$ and $Ar^3$ may independently form a ring together; and n represents an integer of from 1 to 4;

(15)

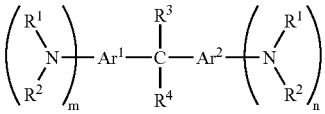

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; m and n independently represent 0 or an integer of from 1 to 3, and are not 0 at the same time; $R^3$ and $R^4$ independently represent a hydrogen atom, a substituted or unsubstituted alkyl group having 1 to 11 carbon atoms and a substituted or unsubstituted aromatic ring group; and $Ar^1$ and $Ar^2$ independently represent a substituted or unsubstituted aromatic ring group, and one of $Ar^1$, $Ar^2$, $R^3$ and $R^4$ is an aromatic heterocyclic group;

(16)

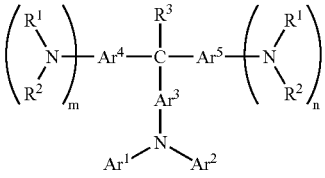

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; m and n independently represent 0 or an integer of from 1 to 3, and are not 0 at the same time; $R^3$ represents a hydrogen atom, a substituted or unsubstituted alkyl group having 1 to 11 carbon atoms and a substituted or unsubstituted aromatic ring group; $Ar^1$, $Ar^2$, $Ar^3$, $Ar^4$ and $Ar^5$ independently represent a substituted or unsubstituted aromatic ring group; and $Ar^1$ and $Ar^2$ or $Ar^1$ and $Ar^3$ may form a heterocyclic group including a nitrogen atom together;

(17)

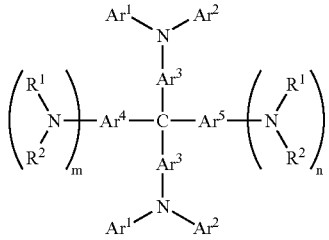

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; m and n independently represent 0 or an integer of from 1 to 3, and are not 0 at the same time; $Ar^1$, $Ar^2$, $Ar^3$, $Ar^4$ and $Ar^5$ independently represent a substituted or unsubstituted aromatic ring group; and $Ar^1$ and $Ar^2$ or $Ar^1$ and $Ar^3$ may form a heterocyclic group including a nitrogen atom together;

(18)

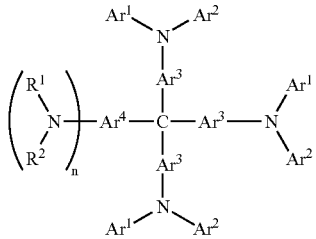

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; n represents an integer of from 1 to 3; $Ar^1$, $Ar^2$, $Ar^3$ and $Ar^4$ independently represent a substituted or unsubstituted aromatic ring group; and $Ar^1$ and $Ar^2$ or $Ar^1$ and $Ar^3$ may form a heterocyclic group including a nitrogen atom together;

(19)

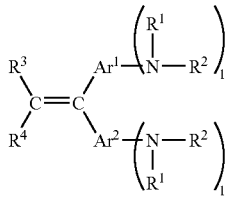

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; 1 represents an integer of from 1 to 3; $Ar^1$ and $Ar^2$ independently represent a substituted or unsubstituted aromatic ring group; $R^3$ and $R^4$ independently represent a hydrogen atom, a substituted or unsubstituted alkyl group having 1 to 4 carbon atoms, a substituted or unsubstituted aromatic ring group or a group having the following formula (20):

(20)

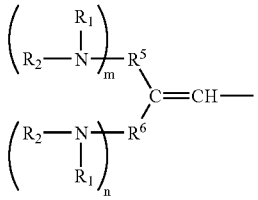

wherein $R^1$ and $R^2$ independently represent an alkyl group having 1 to 4 carbon atoms, which is substituted with an aromatic ring group or an unsubstituted alkyl group having 1 to 4 carbon atoms and maybe combined with each other to form a heterocyclic group including a nitrogen atom; m and n independently represent 0 or an integer of from 1 to 3; and $R^5$ and $R^6$ independently represent a hydrogen atom, a substituted or unsubstituted alkyl group having 1 to 4 carbon atoms or a substituted or unsubstituted aromatic ring group, and wherein $R^3$ and $R^4$, $R^5$ and $R^6$ or $Ar^1$ and $Ar^2$ may independently form a ring together;

(21)

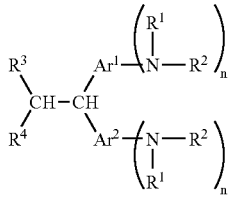

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; n represents an integer of from 1 to 3; $Ar^1$ and $Ar^2$ independently represent a substituted or unsubstituted aromatic ring group; $R^3$ and $R^4$ independently represent a hydrogen atom, a substituted or unsubstituted alkyl group having 1 to 4 carbon atoms, a substituted or unsubstituted aromatic ring group or a group having the following formula (22), and $R^3$ and $R^4$ are not hydrogen atoms at the same time:

(22)

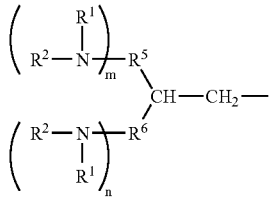

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; m and n independently represent 0 or an integer of from 1 to 3; and $R^5$ and $R^6$ independently represent a hydrogen atom, a substituted or unsubstituted alkyl group having 1 to 4 carbon atoms or a substituted or unsubstituted aromatic ring group, and wherein $R^3$ and $R^4$, $R^5$ and $R^6$ or $Ar^1$ and $Ar^2$ may independently form a ring together;

(23)

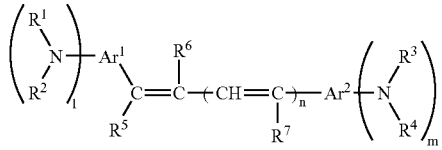

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; $R^3$ and $R^4$ independently represent a substituted or unsubstituted alkyl group having 1 to 4 carbon atoms or a substituted or unsubstituted aromatic ring group; $R^5$, $R^6$ and $R^7$ independently represent a hydrogen atom, a substituted or unsubstituted alkyl group having 1 to 4 carbon atoms or a substituted or unsubstituted aromatic ring group; $Ar^1$ and $Ar^2$ independently represent a substituted or unsubstituted aromatic ring group; $R^3$ and $R^4$ or $Ar^2$ and $R^4$ may form a heterocyclic group including a nitrogen atom together; $Ar^1$ and $R^5$ may form a ring together; 1 represents an integer of from 1 to 3; m represents 0 or an integer of from 1 to 3; and n represents 0 or 1;

(14)

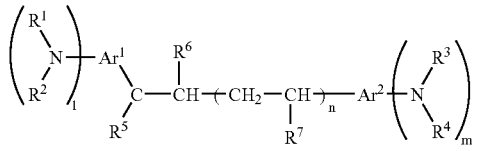

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; $R^3$ and $R^4$ independently represent a substituted or unsubstituted alkyl group having 1 to 4 carbon atoms or a substituted or unsubstituted aromatic ring group; $R^5$, $R^6$ and $R^7$ independently represent a hydrogen atom, a substituted or unsubstituted alkyl group having 1 to 4 carbon atoms or a substituted or unsubstituted aromatic ring group; $Ar^1$ and $Ar^2$ independently represent a substituted or unsubstituted aromatic ring group; $R^3$ and $R^4$ or $Ar^2$ and $R^4$ may form a heterocyclic group including a nitrogen atom together; $Ar^1$ and $R^5$ may form a ring together; 1 represents an integer of from 1 to 3; m represents 0 or an integer of from 1 to 3; and n represents 0 or 1;

(25)

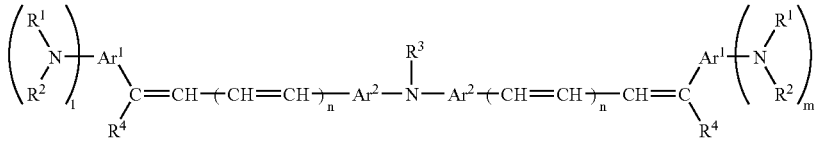

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; 1 and m independently represent 0 or an integer of from 1 to 3, and are not 0 at the same time; $R^3$represents a substituted or unsubstituted alkyl group having 1 to 4 carbon atoms or a substituted or unsubstituted aromatic ring group; $R^4$ represents a hydrogen atom, a substituted or unsubstituted alkyl group having 1 to 4 carbon atoms or a substituted or unsubstituted aromatic ring group; $Ar^1$ and $Ar^2$ represent a substituted or unsubstituted aromatic ring group; $Ar^1$ and $R^4$, $Ar^2$ and $R^3$ or $Ar^2$ and another $Ar^2$ may form a ring together; and n represents 0 or 1;

(26)

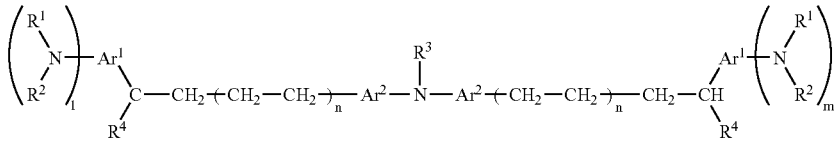

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; 1 and m independently represent 0 or an integer of from 1 to 3, and are not 0 at the same time; $R^3$ represents a substituted or unsubstituted alkyl group having 1 to 4 carbon atoms or a substituted or unsubstituted aromatic ring group; $R^4$ represents a hydrogen atom, a substituted or unsubstituted alkyl group having 1 to 4 carbon atoms or a substituted or unsubstituted aromatic ring group; $Ar^1$ and $Ar^2$ represent a substituted or unsubstituted aromatic ring group; $Ar^1$ and $R^4$, $Ar^2$ and $R^3$ or $Ar^2$ and another $Ar^2$ may form a ring together; and n represents 0 or 1;

(27)

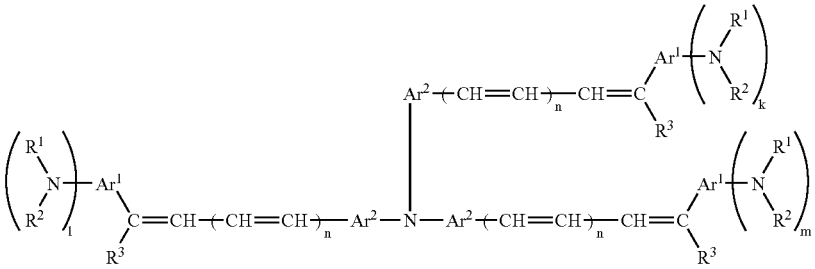

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; k, l and m independently represent 0 or an integer of from 1 to 3, and are not 0 at the same time; $R^3$ represents a hydrogen atom, a substituted or unsubstituted alkyl group having 1 to 4 carbon atoms or a substituted or unsubstituted aromatic ring group; $Ar^1$ and $Ar^2$ represent a substituted or unsubstituted aromatic ring group; $Ar^1$ and $R^4$, $Ar^2$ and $R^3$ or $Ar^2$ and another $Ar^2$ may form a ring together; and n represents 0 or 1; atom, a substituted or unsubstituted alkyl group having 1 to 4 carbon atoms or a substituted or unsubstituted aromatic ring group; $Ar^1$ and $Ar^2$ represent a substituted or unsubstituted aromatic ring group; $Ar^1$ and $R^4$, $Ar^2$ and $R^3$ or $Ar^2$ and another $Ar^2$ may form a ring together; and n represents 0 or 1;

(28)

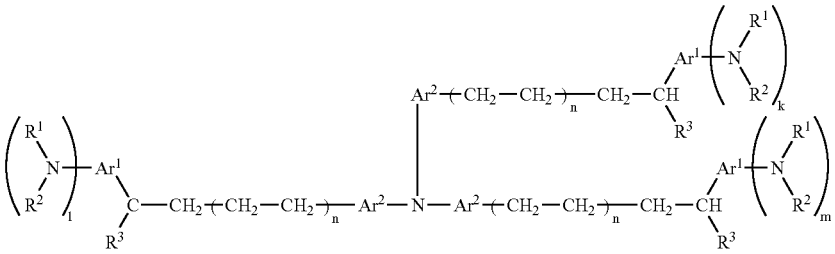

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; k, l and m independently represent 0 or an integer of from 1 to 3, and are not 0 at the same time; $R^3$ represents a hydrogen atom, a substituted or unsubstituted alkyl group having 1 to 4 carbon atoms or a substituted or unsubstituted aromatic ring group; $Ar^1$ and $Ar^2$ represent a substituted or unsubstituted aromatic ring group; $Ar^1$ and $R^4$, $Ar^2$ and $R^3$ or $Ar^2$ and another $Ar^2$ may form a ring together; and n represents 0 or 1;

(29)

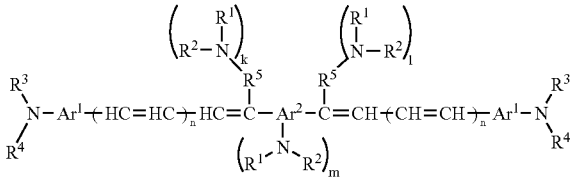

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; $R^3$ and $R^4$ independently represent a substituted or unsubstituted alkyl group having 1 to 4 carbon atoms or a substituted or unsubstituted aromatic ring group; $R^5$ represents a hydrogen atom, a substituted or unsubstituted alkyl group having 1 to 4 carbon atoms or a substituted or unsubstituted aromatic ring group; $Ar^1$ and $Ar^2$ represent a substituted or unsubstituted aromatic ring group; $R^3$ and $R^4$ or $Ar^1$ and $R^4$ may form a heterocyclic group including a nitrogen atom together; k, l and m independently represent 0 or an integer of from 1 to 3; n represents 1 or 2; and $R^3$ and $R^4$ independently represent an alkyl group having 1 to 4 carbon atoms and may be combined with each other to form a heterocyclic group including a nitrogen atom when k, l and m are 0 at the same time;

(30)

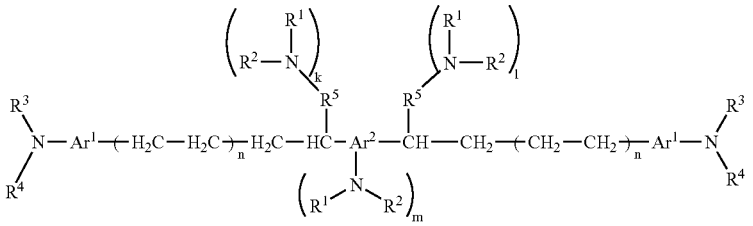

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; $R^3$ and $R^4$ independently represent a substituted or unsubstituted alkyl group having 1 to 4 carbon atoms or a substituted or unsubstituted aromatic ring group; $R^5$ represents a hydrogen atom, a substituted or unsubstituted alkyl group having 1 to 4 carbon atoms or a substituted or unsubstituted aromatic ring group; $Ar^1$ and $Ar^2$ represent a substituted or unsubstituted aromatic ring group; $R^3$ and $R^4$ or $Ar^1$ and $R^4$ may form a heterocyclic group including a nitrogen atom together; m represents 0 or an integer of from 1 to 4; n represents 1 or 2; and $R^3$ and $R^4$ independently represent an alkyl group having 1 to 4 carbon atoms and may be combined with each other to form a heterocyclic group including a nitrogen atom when m is 0;

(31)

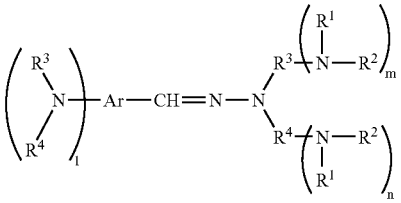

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; Ar represents a substituted or unsubstituted aromatic ring group; $R^3$ and $R^4$represent a hydrogen atom, a substituted or unsubstituted alkyl group having 1 to 4 carbon atoms or a substituted or unsubstituted aromatic ring group; and l, m and n independently represent 0 or an integer of from 1 to 3, and are not 0 at the same time;

(32)

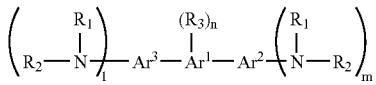

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; $Ar^1$, $Ar^2$ and $Ar^3$ represent a substituted or unsubstituted aromatic ring group; $R^3$ represents a hydrogen atom, a substituted or unsubstituted alkyl group having 1 to 4 carbon atoms or a substituted or unsubstituted aromatic ring group; l and m independently represent 0 or an integer of from 1 to 3, and are not 0 at the same time; and n represents an integer of from 1 to 3;

(33)

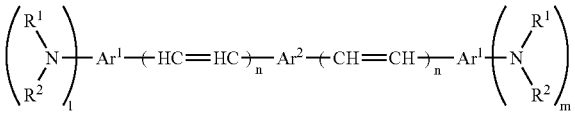

wherein $R^1$ and $R^2$ independently represent an alkyl group substituted with an aromatic hydrocarbon group or an unsubstituted alkyl group and may be combined with each other to form a heterocyclic group including a nitrogen atom; $Ar^1$ and $Ar^2$ represent a substituted or unsubstituted aromatic ring group; l and m independently represent 0 or an integer of from 1 to 3, and are not 0 at the same time; and n represents 1 or 2;

(34)

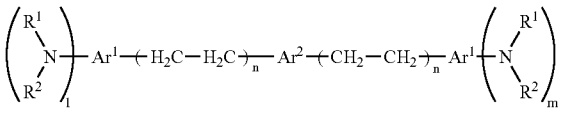

wherein $R^1$ and $R^2$ independently represent an alkyl group substituted with an aromatic hydrocarbon group or an unsubstituted alkyl group and may be combined with each other to form a heterocyclic group including a nitrogen atom; $Ar^1$ and $Ar^2$ represent a substituted or unsubstituted aromatic ring group; l and m independently represent 0 or an integer of from 1 to 3, and are not 0 at the same time; and n represents 1 or 2; and (35)

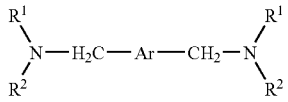

wherein $R^1$ and $R^2$ independently represent substituted or unsubstituted alkyl group and a substituted or unsubstituted aromatic hydrocarbon group, and one of $R^1$ and $R^2$ is a substituted or unsubstituted aromatic hydrocarbon group, and may be combined with each other to form a heterocyclic group including a nitrogen atom; and Ar represents a substituted or unsubstituted aromatic hydrocarbon group.

Specific examples of the alkyl group mentioned in the explanations of these formulae (9) to (35) include a methyl group, an ethyl group, a propyl group, a butyl group, a hexyl group, an undecanyl group, etc. Specific examples of the aromatic hydrocarbon group include aromatic ring groups such as benzene, biphenyl, naphthalene, anthracene, fluorene and pyrene; and aromatic heterocyclic groups such as pyridine, quinoline, thiophene, furan, oxazole, oxadiazole and carbazole. Specific examples of their substituents include the above-mentioned specific examples of the alkyl group; an alkoxy group such as a methoxy group, an ethoxy group, a propoxy group and a butoxy group; a halogen atoms such as a fluorine atom, a chlorine atom, a bromine atom and an iodine atom; the above-mentioned aromatic hydrocarbon groups; and heterocyclic ring groups such as pyrrolidine, piperidine and piperazine. When $R^1$ and $R^2$ are combined with each other to form a heterocyclic group including a nitrogen atom, specific examples thereof include a condensed heterocyclic group such as pyrrolidino groups, piperidino groups and piperazino groups condensed with aromatic hydrocarbon groups.

A method of measuring the oxidation potential (Eox1) of the compound having an alkylamino group and that (Eox2) of the CTM, i.e., a primary oxidation half-wave potential. A predetermined amount of acetonitrile and that of an unrelated salt (a supporting electrolyte) such as tetrabutylammonium perchlorate and tetraethylammonium perchlorate are added to a material to be measured to prepare a test liquid. The oxidation potential of the material can be measured by analyzing the test liquid with an electrochemical analysis methods such as polarographic methods and cyclic voltammetric methods. The electrochemical analysis methods are disclosed in "Electrochemical Methods" written by A. J. Bard and L. R. Faulkner and published by Wiley in 1980 in detail, wherein a potential scanning method using a potentiostat is used, and wherein a dropping mercury electrode is used as a working electrode, a noble metal such as platinum or gold (platinum in "Electrochemical Methods") as a counter electrode and a saturated calomel electrode (SCE) as a reference electrode.

Specific examples of the compound having an alkylamino group and oxidation potential (Eox1) thereof are shown as follows:

| Compound No. | Formula | Eox (V vs. SCE) |
|---|---|---|
| 1 | 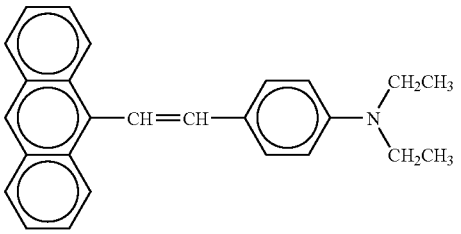 | 0.520 |

-continued
| Compound No. | Formula | Eox (V vs. SCE) |
|---|---|---|
| 2 | 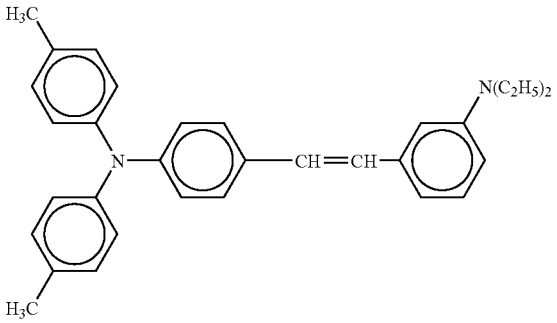 | 0.605 |
| 3 | 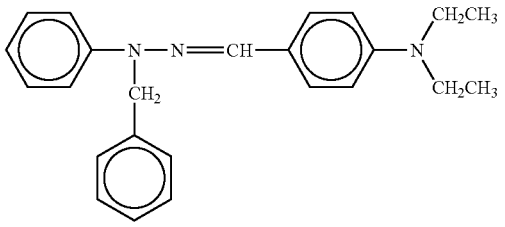 | 0.500 |
| 4 | 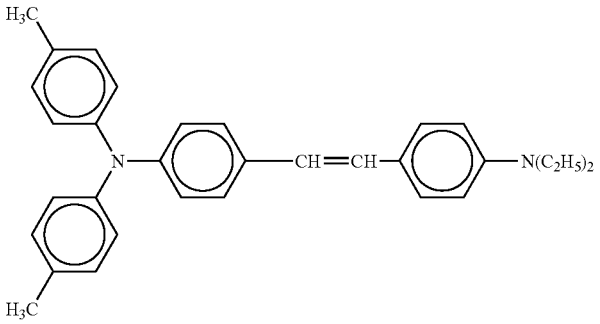 | 0.440 |
| 5 | 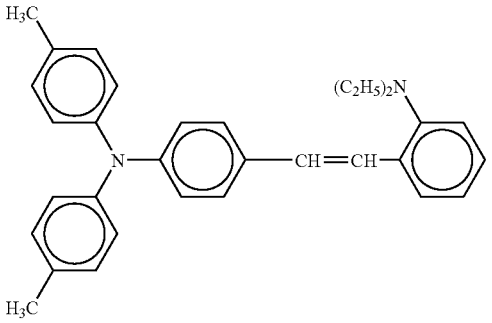 | 0.655 |

-continued
| Compound No. | Formula | Eox (V vs. SCE) |
|---|---|---|
| 6 | 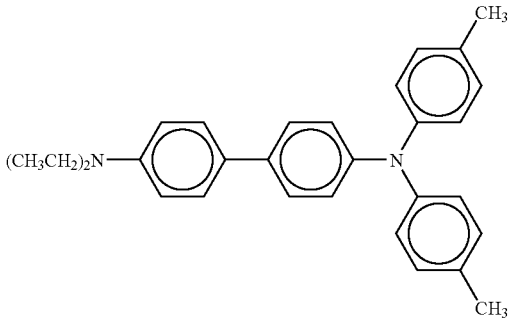 | 0.520 |
| 7 | 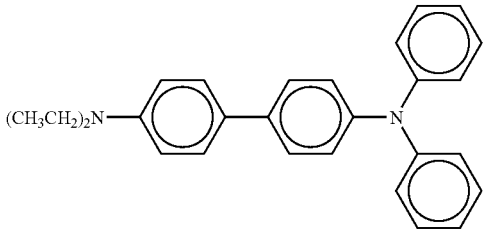 | 0.550 |
| 8 | 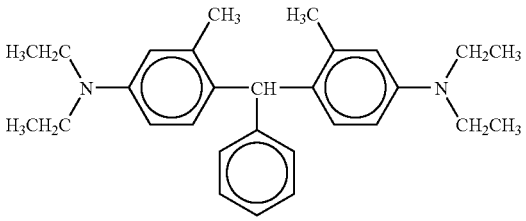 | 0.650 |
| 9 | 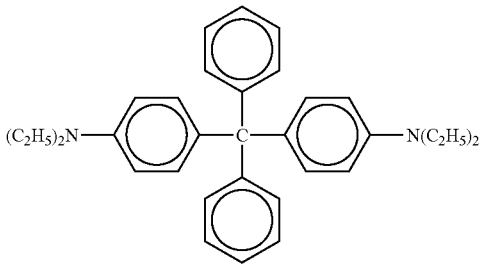 | 0.640 |
| 10 | 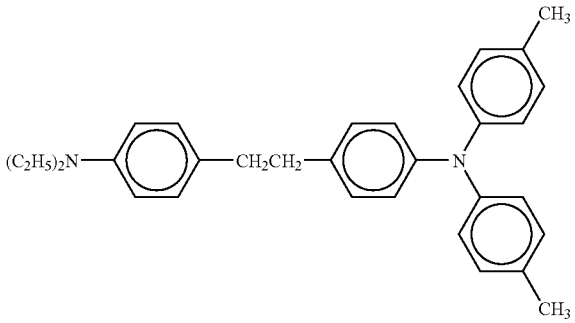 | 0.660 |

-continued
| Compound No. | Formula | Eox (V vs. SCE) |
|---|---|---|
| 11 | 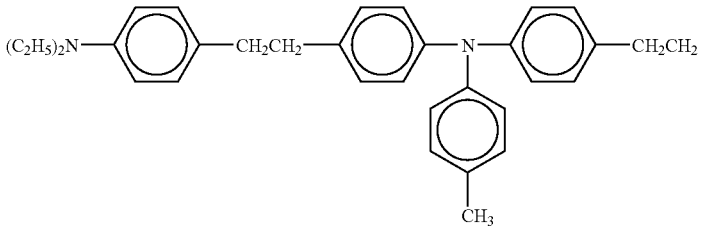 | 0.660 |
| 12 | 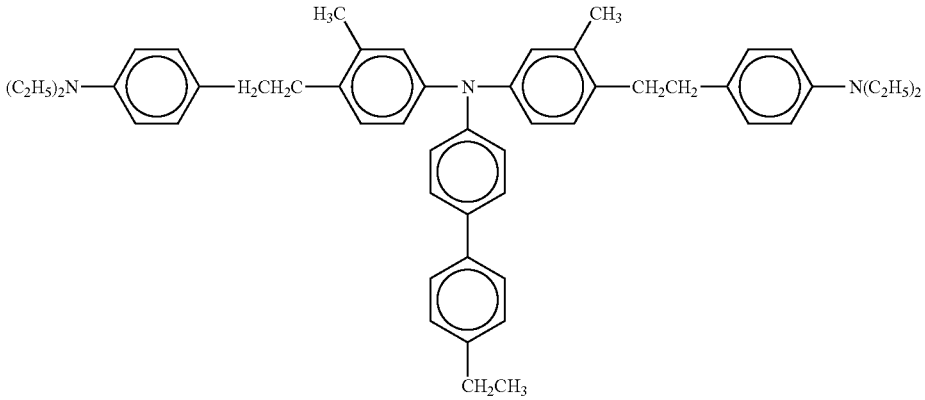 | 0.625 |
| 13 | 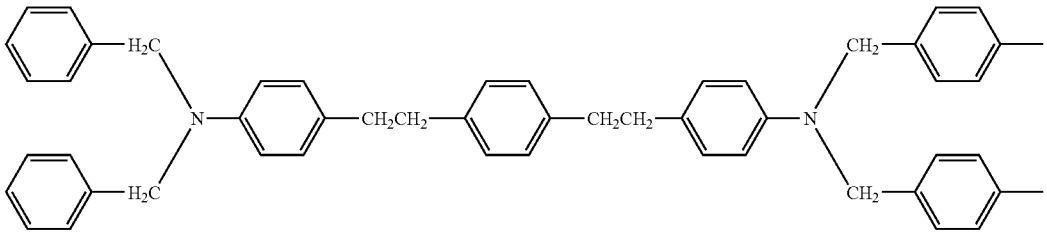 | 0.875 |
| 14 | 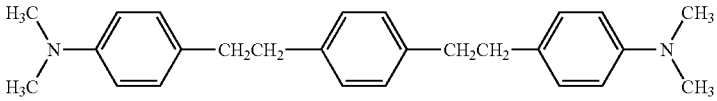 | 0.660 |
| 15 | 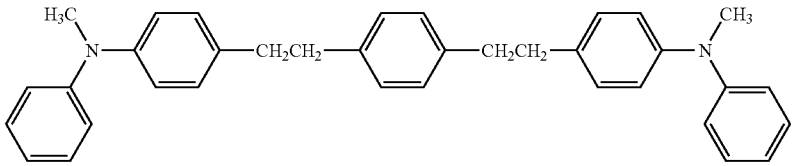 | 0.780 |
| 16 | 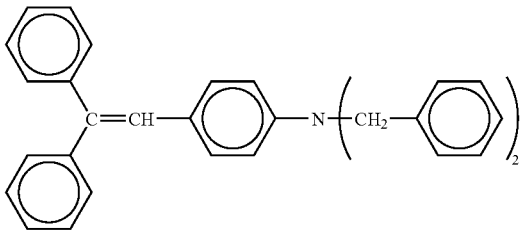 | 0.750 |

-continued
| Compound No. | Formula | Eox (V vs. SCE) |
|---|---|---|
| 17 | 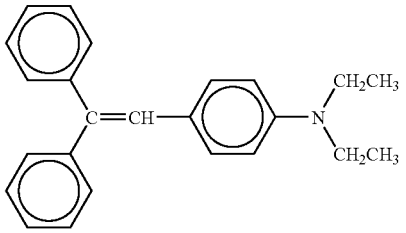 | 0.600 |
| 18 | 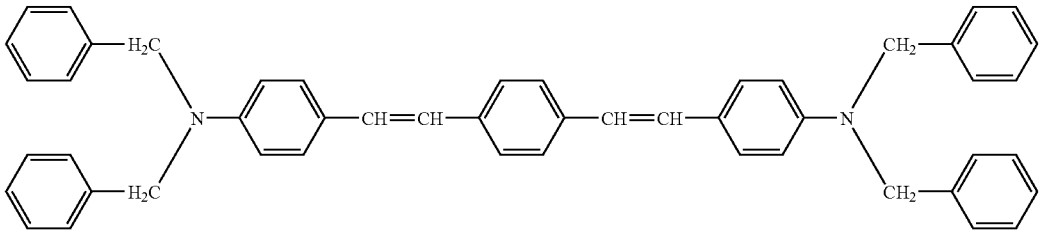 | 0.625 |
| 19 | 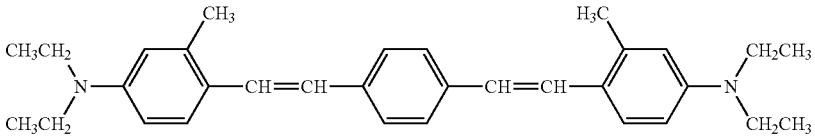 | 0.395 |
| 20 | 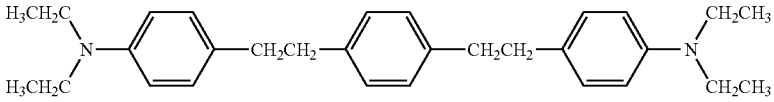 | 0.660 |
| 21 | 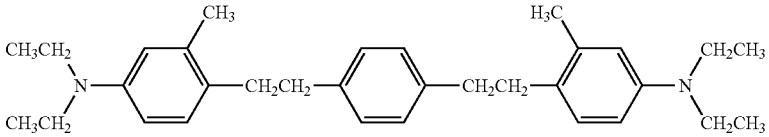 | 0.620 |
| 22 | 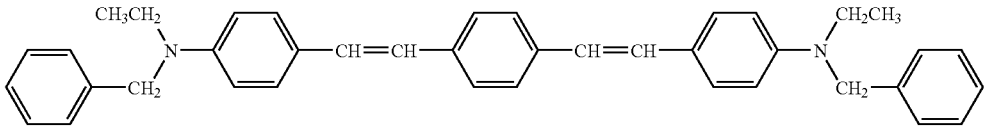 | 0.545 |
| 23 | 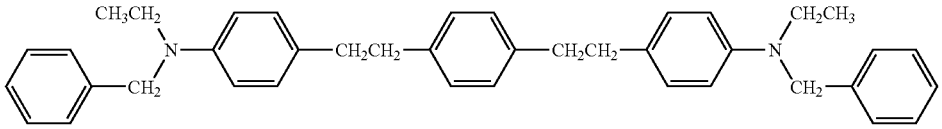 | 0.760 |
| 24 | 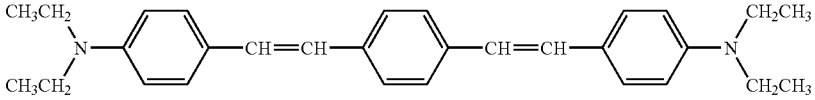 | 0.460 |
| 25 | 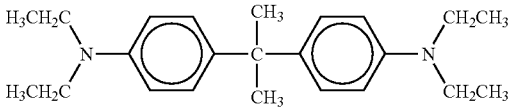 | 0.785 |

-continued
| Compound No. | Formula | Eox (V vs. SCE) |
|---|---|---|
| 26 | 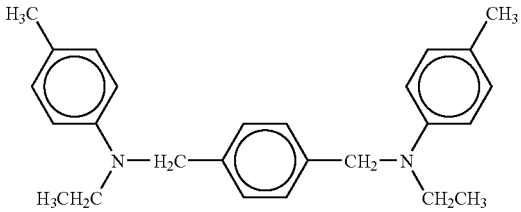 | 0.740 |
| 27 | 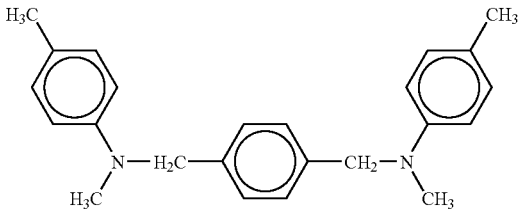 | 0.750 |
| 28 | 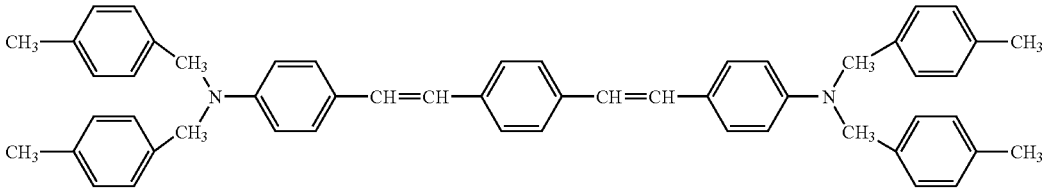 | 0.600 |
| 29 | 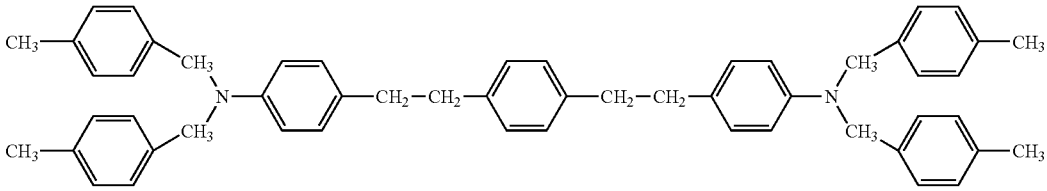 | 0.855 |
| 30 | 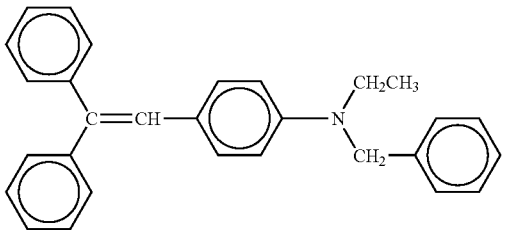 | 0.680 |
| 31 | 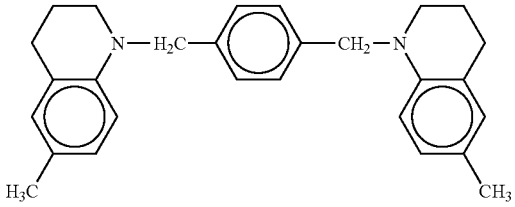 | 0.620 |

-continued

| Compound No. | Formula | Eox (V vs. SCE) |
|---|---|---|
| 32 | 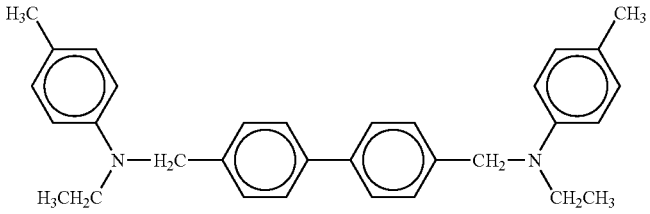 | 0.750 |
| 33 | 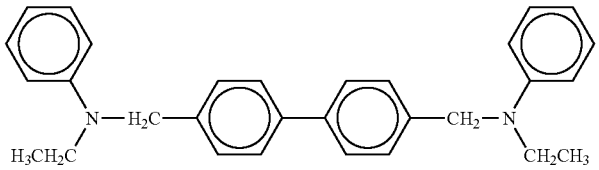 | 0.780 |
| 34 | 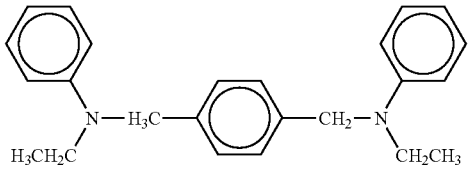 | 0.770 |

Hereinafter, the CTM will be explained. The CTM is classified to a low-molecular-weight CTM and a charge transport polymer material.

Specific examples of the low-molecular-weight CTM include compounds having the following formulae (1), (2), (4) to (6), and (36) to (54).

(36)

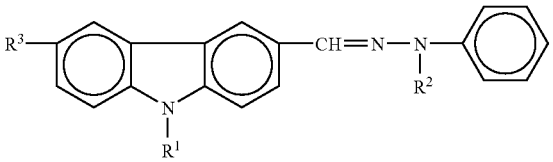

wherein $R^1$ represents a methyl group, an ethyl group, a 2-hydroxyethyl group or a 2-chlorethyl group; and $R^2$ represents a methyl group, an ethyl group, a benzyl group or a phenyl group; and $R^3$ represents a hydrogen atom, a chlorine atom, a bromine atom, an alkyl group having 1 to 4 carbon atoms, an alkoxy group having 1 to 4 carbon atoms, a dialkylamino group or a nitro group.

Specific examples of the compound having formula (36) include 9-ethylcalbazole-3-aldehyde-1-methyl-1-phenylhydrazone, 9-ethylcalbazole-3-aldehyde-1-benzyl-1-phenylhydrazone, 9-ethylcalbazole-3-aldehyde-1-diphenylhydrazone, etc.

(37)

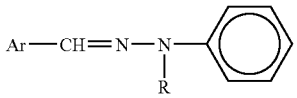

wherein Ar represents a naphthalene ring, an anthracene ring, a pyrene ring and their substituents, a pyridine ring, a furan ring or thiophene ring; and R represents an alkyl group, a phenyl group or a benzyl group.

Specific examples of the compound having formula (37) include 4-diethylaminostyryl-β-aldehhyde-1-methyl-1-phenylhydrazone, 4-methoxynaphthalene-1-aldehyde-1-benzyl-1-phenylhydrazone, etc.

(2)

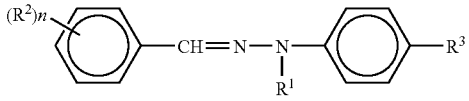

wherein $R^1$ represents an alkyl group, a benzyl group, a phenyl group or a naphtyl group; $R^2$ represents a hydrogen atom, an alkyl group having 1 to 3 carbon atoms, an alkoxy group having 1 to 3 carbon atoms, a dialkylamino group, diaralkylamino group or a diarylamino group; n represents an integer of from 1 to 4 and $R^2$ may be the same or different from each other when n is not less than 2; and $R^3$ represents a hydrogen atom or a methoxy group.

Specific examples of the compound having formula (2) include 4-methoxybenzaldehyde-1-methyl-1-phenylhydrazone, 2,4-dimethoxybenzaldehyde-1-benzyl-1-phenylhydrazone, 4-diethylaminobenzaldehyde-1,1-diphenylhydrazone, 4-methoxybenzaldehyde-1-(4-methoxy)phenylhydrazone, 4-diphenylaminobenzaldehyde-1-benzyl-1-phenylhydrazone, 4-dibenzylaminobenzaldehyde-1,1-diphenylhydrazone, etc.

(38)

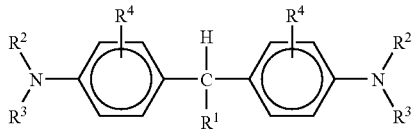

wherein $R^1$ represents an alkyl group having 1 to 11 carbon atoms, a substituted or unsubstituted phenyl group or a heterocyclic ring group; $R^2$ and $R^3$ independently represent a hydrogen atom, an alkyl group having 1 to 4 carbon atoms, a hydroxyalkyl group, a chloralkyl group or a substituted or unsubstituted aralkyl group, and may be combined each other to form a heterocyclic ring group including a nitrogen atom; and $R^4$ independently represent a hydrogen atom, an alkyl group having 1 to 4 carbon atoms, an alkoxy group or a halogen atom.

Specific examples of the compound having the formula (38) include 1,1-bis(4-dibenzylaminophenyl)propane, tris(4-diethylaminophenyl)methane, 1,1-bis(4-dibenzylaminophenyl)propane, 2,2'-dimethyl-4,4'-bis(diethylamino)-triphenylmethane, etc.

(39)

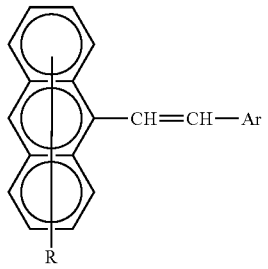

wherein R represents a hydrogen atom or a halogen atom; and Ar represents a substituted or unsubstituted phenyl group, a naphtyl group, an anthryl group or a carbazolyl group.

Specific examples of the compound having the formula (39) include 9-(4-diethylaminostyryl)anthracene, 9-bromo-10-(4-diethylaminostyryl)anthracene, etc.

(40)

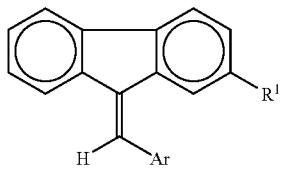

wherein $R^1$ represents a hydrogen atom, a cyano group, an alkoxy group having 1 to 4 carbon atoms or a alkyl group having 1 to 4 carbon atoms; and Ar represents a group having the following formulae (41) and (42):

(41)

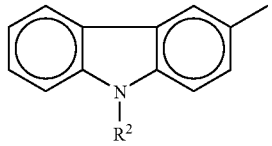

(42)

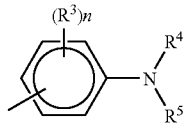

wherein $R^2$ represents an alkyl group having 1 to 4 carbon atoms; $R^3$ represents a hydrogen atom, a halogen atom, an alkyl group having 1 to 4 carbon atoms, an alkoxy group having 1 to 4 carbon atoms or a dialkylamino group; n is 1 or 2, and $R^3$ may be the same or different from each other when n is 2; and $R^4$ and $R^5$ represent a hydrogen atom, a substituted or unsubstituted alkyl group having 1 to 4 carbon atoms or a substituted or unsubstituted benzyl group.

Specific examples of the compound having the formula (40) include 9-(4-dimethylaminobenzylidene)fluorene, 3-(9-fluorenylidene)-9-ethylcarbazole, etc.

(43)

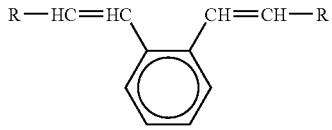

wherein R represents a carbazolyl group, a pyridyl group, a thienyl group, an indolyl group, a furyl group, a substituted or unsubstituted phenyl, styryl, naphtyl group or an anthryl group, and their substituents are selected from the group consisting of a dialkylamino group, an alkyl group, an alkoxy group, a carboxyl group or its ester, a halogen atom, a cyano group, an aralkylamino group, N-alkyl-N-aralkylamino group, an amino group, a nitro group and an acethylamino group.

Specific examples of the compound having the formula (43) include 1,2-bis-(4-diethylaminostyryl)benzene, 1,2-bis(2-,4-dimethoxystyryl)benzene, etc.

(44)

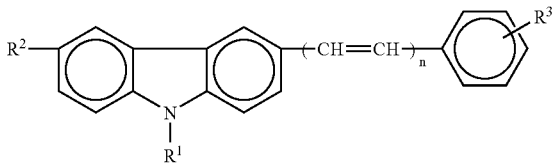

wherein $R^1$ represents a lower alkyl group, a substituted or unsubstituted phenyl group or a benzyl group; $R^2$ and $R^3$ represent a hydrogen atom, a lower alkyl group, a lower alkoxy group, a halogen atom, a nitro group, an amino group or an amino group substituted by a lower alkyl group or a benzyl group; and n is 1 or 2.

Specific examples of the compound having the formula (44) include 3-styryl-9-ethylcarbazole, 3-(4-methoxystyryl)-9-ethylcarbazole, etc.

(45)

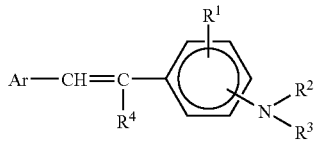

wherein $R^1$ represents a hydrogen atom, an alkyl group, an alkoxy group or a halogen atom; $R^2$ and $R^3$ represent a substituted or unsubstituted aryl group; $R^4$ represents a hydrogen atom, a lower alkyl group or a substituted or unsubstituted phenyl group; and Ar represents a substituted or unsubstituted phenyl group or a naphtyl group.

Specific examples of the compound having the formula (31) include 4-diphenylaminostilbene, 4-dibenzylaminostilbene, 4-ditolylaminostilbene, 1-(4-iphenylaminostyryl) naphthalene, 1-(4-diethylaminostyryl)naphthalene, etc.

(1)

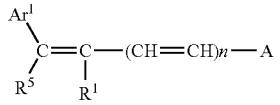

wherein n is 0 or 1; $R^1$ represents a hydrogen atom, an alkyl group or a substituted or unsubstituted phenyl group; $Ar^1$ represents a substituted or unsubstituted aryl group; $R^5$ represents an alkyl group having 1 to 4 carbon atoms or a substituted or unsubstituted aryl group; and A represents a 9-anthryl group, a substituted or unsubstituted carbazolyl group or a group having the following formula (4) or (5):

(4)

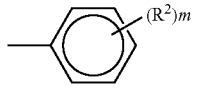

(5)

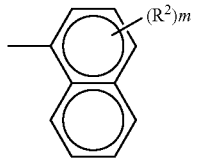

wherein $R^2$ represents a hydrogen atom, an alkyl group, an alkoxy group, a halogen atom or a group having the following formula; and m is an integer of from 1 to 3;

(6)

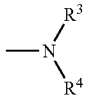

wherein $R^3$ and $R^4$ independently represent a substituted or unsubstituted aryl group, and $R^4$ may form a ring, and wherein $R^2$ may be the same or different from each other when m is not less than 2, and A and $R^1$ may form a ring together when n is 0.

Specific examples of the compound having the formula (1) include 4'-diphenylamino-α-phenylstilbene, 4'-bis (4-methylphenyl)amino-α-phenylstilbene, etc.

(46)

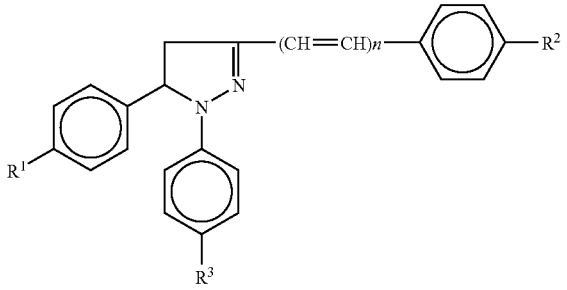

wherein $R^1$, $R^2$ and $R^3$ represent a hydrogen atom, a lower alkyl group, a lower alkoxy group, a halogen atom or a dialkylamino group; and n is 0 or 1.

Specific examples of the compound having the formula (46) include 1-phenyl-3-(4-diethylaminostyryl)-5-(4-diethylaminophenyl)pyrazoline, etc.

(47)

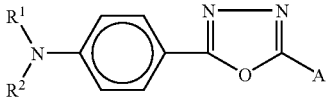

wherein $R^1$ and $R^2$ represent an alkyl group including a substituted alkyl group or a substituted or unsubstituted aryl group; and A represents a substituted amino group, a substituted or unsubstituted aryl group or an aryl group.

Specific examples of the compound having the formula (47) include 2,5-bis(4-diethylaminophenyl)-1,3,4-oxadiazole, 2-N,N-diphenylamino-5-(4-diethylaminophenyl)-1,3,4-oxadiazole, 2-(4-dimethylaminophenyl)-5-(4-diethylaminophenyl)-1,3,4-oxadiazole, etc.

(48)

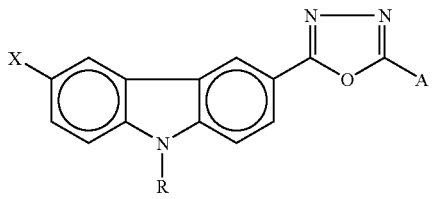

wherein X represents a hydrogen atom, a lower alkyl group or a halogen atom; R represents an alkyl group including a substituted alkyl group or a substituted or unsubstituted aryl group; and A represents a substituted amino group, a substituted or unsubstituted aryl group or an aryl group.

Specific examples of the compound having the formula (48) include 2-N,N-diphenylamino-5-(N-ethylcarbazole-3-yl)-1,3,4-oxadiazole, 2-(4-diethylaminophenyl)-5-(N-ethylcarbazole-3-yl)-1,3,4-oxadiazole, etc.

(49)

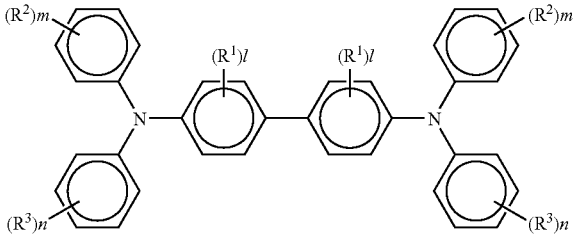

wherein $R^1$ represents a lower alkyl group, a lower alkoxy group or a halogen atom; $R^2$ and $R^3$ independently represent a hydrogen atom, a lower alkyl group, a lower alkoxy group or a halogen atom; and l, m and n independently represent 0 or an integer of from 1 to 4.

Specific examples of the benzidine compound having the formula (49) include N,N'-diphenyl-N,N'-bis(3-methylphenyl)-[1,1'-biphenyl]-4,4'-diamine, 3,3'-dimethyl-N,N,N',N'-tetrakis(4-methylphenyl)-[1,1'-biphenyl]-4,4'-diamine, etc.

(50)

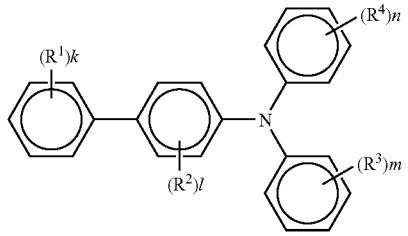

wherein $R^1$ $R^3$ and $R^4$ represent a hydrogen atom, an amino group, an alkoxy group, a thioalkoxy group, an aryloxy group, a methylenedioxy group, a substituted or unsubstituted alkyl group, a halogen atom or a substituted or unsubstituted aryl group; $R^2$ represents a hydrogen atom, an alkoxy group, a substituted or unsubstituted alkyl group or a halogen atom, but a case in which $R^1$, $R^2$, $R^3$ and $R^4$ are all hydrogen atoms is excluded; and k, l, m, and n are independently an integer of from 1 to 4, and $R^1$, $R^2$, $R^3$ and $R^4$ may be the same or different from the others when k, l, m, and n are an integer of from 2 to 4.

Specific examples of the biphenylamine compound having the formula (50) include 4'-methoxy-N,N-diphenyl-[1,1'-biphenyl]-4-amine, 4'-methyl-N,N-bis (4-methylphenyl)-[1,1'-biphenyl]-4-amine, 4'-methoxy-N,N-bis(4-methylphenyl)-[1,1'-biphenyl]-4-amine, N,N-bis(3,4-dimethylphenyl)-[1,1'-biphenyl]-4-amine, etc.

(51)

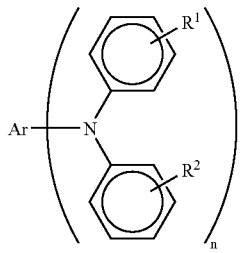

wherein Ar represents a condensation polycyclic hydrocarbon group having 18 or less carbon atoms which can have a substituent; and $R^1$ and $R^2$ independently represent a hydrogen atom, a halogen atom, a substituted or unsubstituted alkyl group, an alkoxy group, or a substituted or unsubstituted phenyl group and n is 1 or 2.

Specific examples of the triarylamine compound having the formula (51) include N,N-diphenyl-pyrene-1-amine, N,N-di-p-tolyl-pyrne-1-amine, N,N-di-p-tolyl-1-naphthylamine, N,N-di(p-tolyl)-1-phenanthorylamine, 9,9-dimethyl-2-(di-p-tolylamino)fluorene, N,N,N',N'-tetrakis(4-methylphenyl)-phenanthrene-9,10-diamine, N,N,N',N'-tetrakis (3-methylphenyl)-m-phenylenediamine, etc.

$$A—CH=CH—Ar—CH=CH—A \quad (52)$$

wherein Ar represents a substituted or unsubstituted aromatic hydrocarbon group; and A represents the following formula (53):

(53)

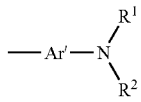

wherein Ar' represents a substituted or unsubstituted aromatic hydrocarbon group; and $R^1$ and $R^2$ represent substituted or unsubstituted alkyl group or a substituted or unsubstituted aryl group.

Specific examples of the diolefin aromatic compound having the formula (52) include 1,4-bis (4-diphenylaminostyryl)benzene, 1,4-bis[4-di(p-tolyl)aminostyryl]benzene, etc.

(54)

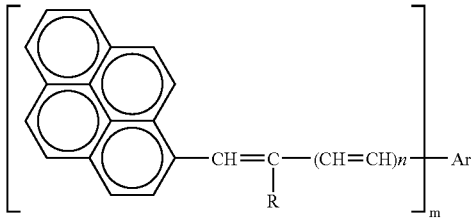

wherein Ar represents a substituted or unsubstituted aromatic hydrocarbon group; R represents a hydrogen atom, a substituted or unsubstituted alkyl group or a substituted or unsubstituted aryl group; n is 0 or 1; m is 1 or 2; and Ar and R may form a ring when n is 0 and m is 1.

Specific examples of the styrylpyrene compound having the formula (54) include 1-(4-diphenylaminostyryl)pyrene, 1-[4-di(p-tolyl) aminostyryl]pyrene, etc.

Specific examples of an electron transport materials include chloranil, bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-indeno[1,2-b]thiophene-4-one, and 1,3,7-trinitrodibenzothiophene-5,5-dioxide, etc. In addition, electron transport materials having the following formulae (55), (56) and (57) are preferably used.

(55)

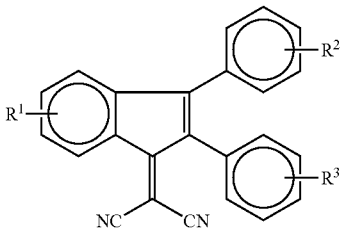

wherein $R^1$, $R^2$ and $R^3$ independently represent a hydrogen atom, a halogen atom, a substituted or unsubstituted alkyl group, an alkoxy group or a substituted or unsubstituted phenyl group;

(56)

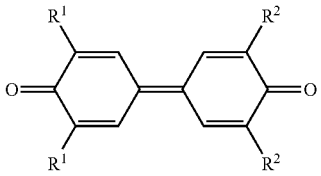

wherein $R^1$ and $R^2$ independently represent a hydrogen atom, a substituted or unsubstituted alkyl group, or a substituted or unsubstituted phenyl group;

(57)

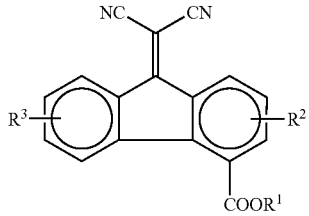

wherein $R^1$, $R^2$ and $R^3$ independently represent a hydrogen atom, a halogen atom, a substituted or unsubstituted alkyl group, an alkoxy group or a substituted or unsubstituted phenyl group.

These CTMs can be used alone or in combination.

In the present invention, among the above-mentioned low-molecular-weight CTMs, the low-molecular-weight CTMs having formulae (1) and (2) are preferably used because of particularly having good transportability and good properties of receiving charges from CGMs. Therefore, an electrophotographic photoreceptor including the low-molecular-weight CTMs having formulae (1) and (2) in its photosensitive layer has high sensitivity.

Specific examples of the charge transport polymer material include compounds having the following formulae (3), (7), (8) and (58) to (69):

(3)

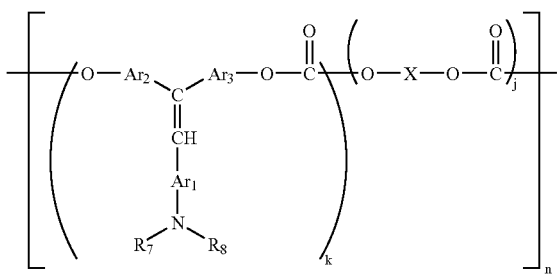

wherein $R^7$ and $R^8$ independently represent a substituted or unsubstituted aromatic ring group; $Ar^1$, $Ar^2$ and $Ar^3$ independently represent an aromatic ring group; k is a number of from 0.1 to 1.0 and j is a number of from 0 to 0.9; n represents a repeating number and is an integer of from 5 to 5,000; and X represents a divalent aliphatic group, a divalent alicyclic group or a divalent group having the following formula (7):

(7)

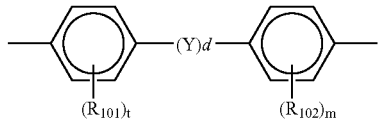

wherein, $R^{101}$ and $R^{102}$ independently represent a substituted or unsubstituted alkyl group, a substituted or unsubstituted aryl group, or a halogen atom; t and m independently represent 0 or an integer of from 1 to 4; d is 0 or 1; and Y represents a linear alkylene group, a branched alkylene group, a cyclic alkylene group, —O—, —S—, —SO—, —$SO_2$—, —CO—, —CO—O—Z—O—CO— (Z represents a divalent aliphatic group), or a group having the following formula (8):

(8)

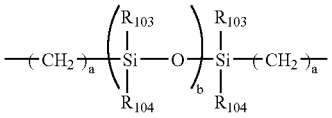

wherein, a is an integer of from 1 to 20; b is an integer of from 1 to 2,000; and $R^{103}$ and $R^{104}$ independently represent a substituted or unsubstituted alkyl group, or a substituted or unsubstituted aryl group, and wherein $R^{101}$, $R^{102}$, $R^{103}$ and $R^{104}$ may be the same or different from the others.

(58)

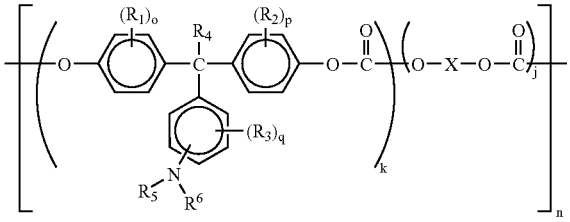

wherein, $R_1$, $R_2$ and $R_3$ independently represent a substituted or unsubstituted alkyl group, or a halogen atom; $R_4$ represents a hydrogen atom, or a substituted or unsubstituted alkyl group; $R_5$, and $R_6$ independently represent a substituted or unsubstituted aryl group; o, p and q independently represent 0 or an integer of from 1 to 4; and X, k, j and n are same in formula (3);

(59)

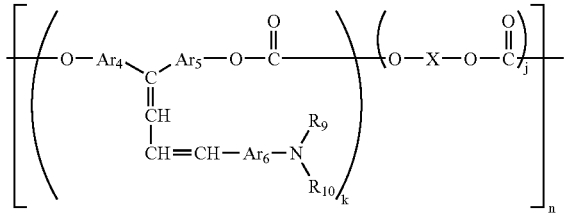

wherein, $R_9$ and $R_{10}$ represent a substituted or unsubstituted aryl group; $Ar_4$, $Ar_5$ and $Ar_6$ independently represent an arylene group; and X, k, j and n are same in formula (3);

(60)

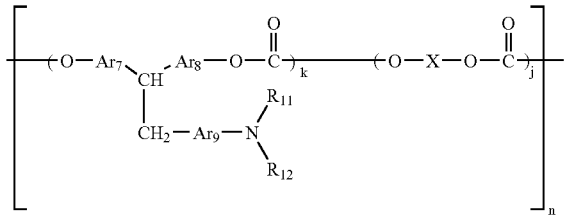

wherein, $R_{11}$ and $R_{12}$ represent a substituted or unsubstituted aryl group; $Ar_7$, $Ar_8$ and $Ar_9$ independently represent an arylene group; p is an integer of from 1 to 5; and X, k, j and n are same in formula (3);

(61)

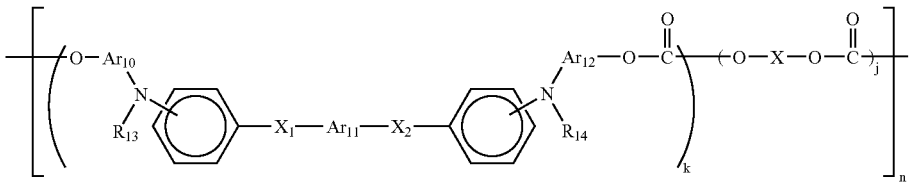

wherein, $R_{13}$ and $R_{14}$ represent a substituted or unsubstituted aryl group; $Ar_{10}$, $Ar_{11}$ and $Ar_{12}$ independently represent an arylene group; $X_1$ and $X_2$ represent a substituted or unsubstituted ethylene group, or a substituted or unsubstituted vinylene group; and X, k, j and n are same in formula (3);

(62)

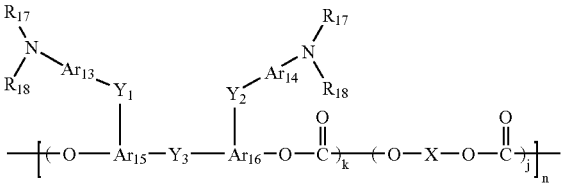

wherein, $R_{15}$, $R_{16}$, $R_{17}$ and $R_{18}$ represent a substituted or unsubstituted aryl group; $Ar_{13}$, $Ar_{14}$, $Ar_{15}$ and $Ar_{16}$ independently represent an arylene group; $Y_1$, $Y_2$ and $Y_3$ independently represent a direct bonding, a substituted or unsubstituted alkylene group, a substituted or unsubstituted cycloalkylene group, a substituted or unsubstituted alkylene ether group, an oxygen atom, a sulfur atom, or a vinylene group; and X, k, j and n are same in formula (3);

(63)

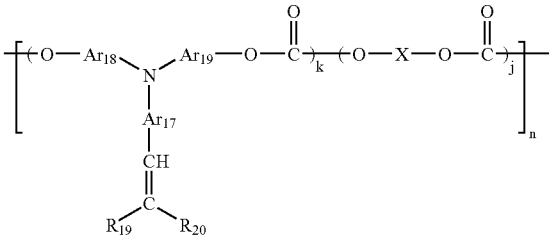

wherein, $R_{19}$ and $R_{20}$ represent a hydrogen atom, or substituted or unsubstituted aryl group, and $R_{19}$ and $R_{20}$ may form a ring; $Ar_{17}$, $Ar_{18}$ and $Ar_{19}$ independently represent an arylene group; and X, k, j and n are same in formula (3);

(64)

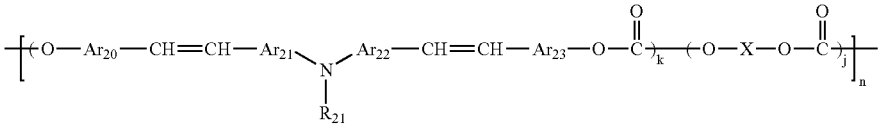

wherein, $R_{21}$ represents a substituted or unsubstituted aryl group; $Ar_{20}$, $Ar_{21}$, $Ar_{22}$ and $Ar_{23}$ independently represent an arylene group; and X, k, j and n are same in formula (3);

(65)

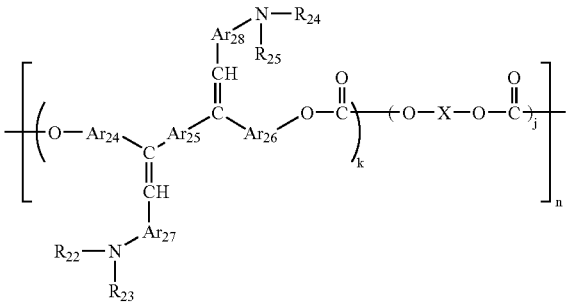

wherein, $R_{22}$, $R_{23}$, $R_{24}$ and $R_{25}$ represent a substituted or unsubstituted aryl group; $Ar_{24}$, $Ar_{25}$, $Ar_{26}$, $Ar_{27}$ and $Ar_{28}$ independently represent an arylene group; and X, k, j and n are same in formula (3);

(66)

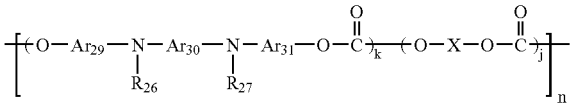

wherein, $R_{26}$ and $R_{27}$ independently represent a substituted or unsubstituted aryl group; $Ar_{29}$, $Ar_{30}$ and $Ar_{31}$ independently represent an arylene group; and X, k, j and n are same in formula (3);

(67)

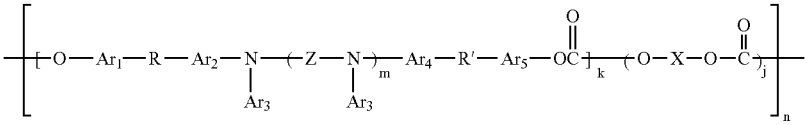

wherein $Ar_1$, $Ar_2$ $Ar_3$, $Ar_4$ and $Ar_5$ represent a substituted or unsubstituted aromatic ring group; Z represents an aromatic ring group or —$Ar_6$—Za—$Ar_6$—; $Ar_6$ represents a substituted or unsubstituted aromatic ring group; Za represents O,S or an alkylene group; R and R' represent a linear alkylene group or a branched alkylene group; m is 0 or 1; and X, k, j and n are same in formula (3).

In the present invention, among the above-mentioned charge transport polymer materials, the charge transport polymer material having formula (3) is preferably used because of particularly having good abrasion resistance and good transportability. Therefore, an electrophotographic photoreceptor including the charge transport polymer material having formula (3) in its photosensitive layer has high durability and sensitivity.

Next, layer compositions of the electrophotographic photoreceptor of the present invention will be explained, referring to FIGS. 1 to 5.

FIG. 1 is a schematic view illustrating a cross section of a surface of an embodiment of the photoreceptor of the present invention, in which a photosensitive layer 33 including a CGM the main components is formed on an electroconductive substrate 31.

Figure 2:
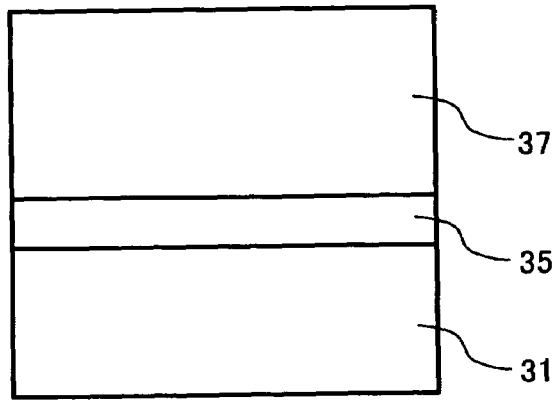
FIG. 2 is a cross-sectional view of another embodiment of the photosensitive layer of the electrophotographic photoreceptor of the present invention.

In FIG. 2, a CGL 35 including a CGM as the main component overlies a CTL 37 including a CTM as the main component on an electroconductive substrate 31.

Figure 3:
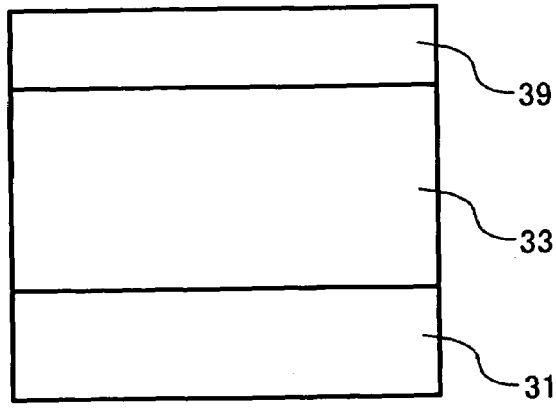
FIG. 3 is a cross-sectional view of a third embodiment of the photosensitive layer of the electrophotographic photoreceptor of the present invention.

In FIG. 3, a photosensitive layer 33 including a CGM and a CTM as the main components is formed on an electroconductive substrate 31, and further a protection layer 39 is formed on a surface of the photosensitive layer. In this case, the protection layer 39 may include an amine compound of the present invention.

Figure 4:
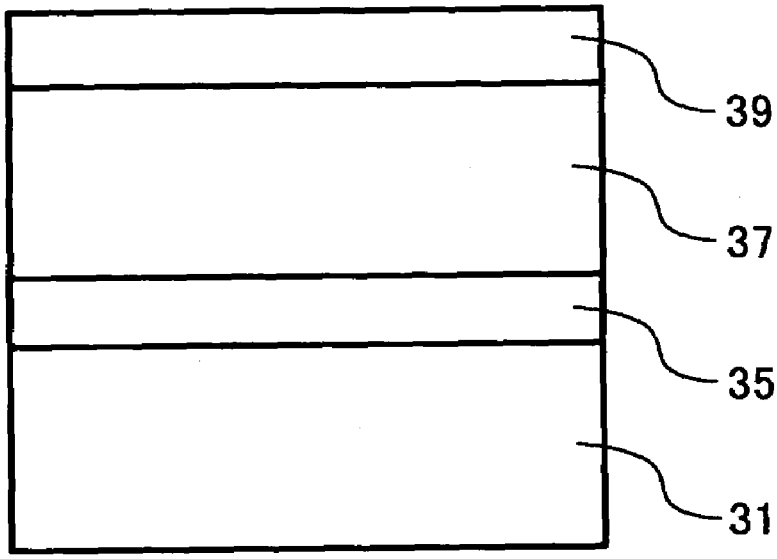
FIG. 4 is a cross-sectional view of a fourth embodiment of the photosensitive layer of the electrophotographic photoreceptor of the present invention.

In FIG. 4, a CGL 35 including a CGM as the main component, a CTL 37 including a CTM as the main component overlying the CGL, and further a protection layer 39 overlying the CTL are formed on an electroconductive substrate 31. In this case, the protection layer 39 may include an amine compound of the present invention.

Figure 5:
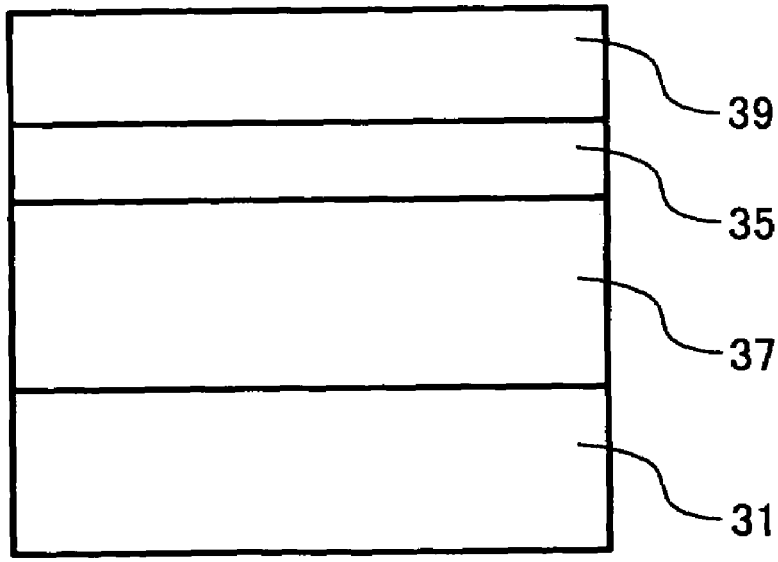
FIG. 5 is a cross-sectional view of a fifth embodiment of the photosensitive layer of the electrophotographic photoreceptor of the present invention.

In FIG. 5, a CTL 37 including a CTM as the main component, a CGL 35 including a CGM as the main component overlying the CTL, and further a protection layer 39 overlying the CGL are formed on an electroconductive substrate 31. In this case, the protection layer 39 may include an amine compound of the present invention.

Suitable materials for use as the electroconductive substrate 31 include materials having a volume resistance not greater than $10^{10}\Omega\cdot$cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing and the like treatments, can be also used as the substrate. Further, endless belts of a metal such as nickel and stainless steel, which have been disclosed in Japanese Laid-Open Patent Publication No. 52-36016, can be also used as the electroconductive substrate 31.

Furthermore, substrates, in which a coating liquid including a binder resin and an electroconductive powder is coated on the supporters mentioned above, can be used as the substrate 31. Specific examples of such an electroconductive powder include carbon black, acetylene black, powders of metals such as aluminum, nickel, iron, Nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins. Such an electroconductive layer can be formed by coating a coating liquid in which an electroconductive powder and a binder resin are dispersed in a solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can be also used as the substrate 31.

Next, the photosensitive layer of the present invention will be explained. In the present invention, the photosensitive layer may be single-layered or a multi-layered. At first, the multi-layered photosensitive layer including the CGL 35 and the CTL 37 will be explained for explanation convenience.

The CGL 35 is a layer including a CGM as the main component. Known CGMs can be used in the CGL 35. Specific examples of the CGM include azo pigments such as CI Pigment Blue 25 (color index CI 21180), CI Pigment Red 41 (CI 21200), CI Acid Red 52 (CI 45100), CI Basic Red 3 (CI 45210), an azo pigment having a carbazole skeleton disclosed in Japanese Laid-Open Patent Publication (JLPP) No. 53-95033, an azo pigment having a distyrylbenzene skeleton disclosed in JLPP No. 53-133445, an azo pigment having a triphenylamine skeleton disclosed in JLPP No. 53-132347, an azo pigment having a dibenzothiophene skeleton disclosed in JLPP No. 54-21728, an azo pigment having an oxadiazole skeleton disclosed in JLPP No. 54-12742, an azo pigment having a fluorenone skeleton disclosed in JLPP No. 54-22834, an azo pigment having a bisstilbene skeleton disclosed in JLPP No. 54-17733, an azo pigment having a distyryloxadiazole skeleton disclosed in JLPP No. 54-2129, an azo pigment having a distyrylcarbazole skeleton disclosed in JLPP No. 54-14967 and an azo pigment having a benzanthrone skeleton; phthalocyanine pigments such as CI Pigment Blue 16 (CI 74100), Y-type oxotitaniumphthalocyanine disclosed in JLPP No. 64-17066, A(β)-type oxotitaniumphthalocyanine, B(α)-type -type oxotitaniumphthalocyanine, I-type oxotitaniumphthalocyanine disclosed in JLPP No. 11-21466, II-type chlorogalliumphthalocyanine disclosed by Mr. Iijima and others in the 67$^{th}$ spring edition 1B4, 04 published by Chemical Society of Japan in 1994, V-type hydroxygalliumphthalocyanine disclosed Mr. Daimon and others in the 67$^{th}$ spring edition 1B4, 05 published by Chemical Society of Japan in 1994 and X-type metal-free phthalocyanine disclosed in U.S. Pat. No. 3,816,118; indigo pigments such as CI Vat Brown 5 (CI 73410) and CI Vat Dye (CI 73030); and perylene pigments such as Algo Scarlet B from Bayer AG and Indanthrene Scarlet R from Bayer AG. These materials can be used alone or in combination.

The CGL 35 can be prepared by dispersing a CGM in a proper solvent optionally together with a binder resin using a ball mill, an attritor, a sandmill or a supersonic dispersing machine, coating the coating liquid on an electroconductive substrate and then drying the coated liquid.

Specific example of the binder resins optionally used in the CGL 35, include polyamides, polyurethanes, epoxy resins, polyketones, polycarbonates, silicone resins, acrylic resins, polyvinyl butyral, polyvinyl formal, polyvinyl ketones, polystyrene, polysulfone, poly-N-vinylcarbazole, polyacrylamide, polyvinyl benzal, polyesters, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, and the like resins. The content of the binder resin in the CGL 35 is preferably from 0 to 500 parts by weight, and preferably from 10 to 300 parts by weight, per 100 parts by weight of the CGM. The binder resin can be included either before or after dispersion of the CGM in the solvent.

Specific examples of the solvent include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, and the like solvents. In particular, ketone type solvents, ester type solvents and ether type solvents are preferably used. These can be used alone or in combination.

The CGL 35 includes a CGM, a solvent and a binder rein as the main components. Any additives such as a sensitizer, a disperser, a detergent and a silicone oil can be included therein.

The coating liquid can be coated by a coating method such as dip coating, spray coating, bead coating, nozzle coating, spinner coating and ring coating. The CGL 35 preferably has a thickness of from 0.01 to 5 μm, and more preferably from 0.1 to 2 μm.

The CTL 37 is a layer including a CTM as the main component and a compound having an alkylamino group. The CTMs having the above-mentioned formulae (1) to (8) and (36) to (67) are preferably used, and the compound having an alkylamino group CTMs having the above-mentioned formulae (9) to (35) (specifically the above-mentioned compounds Nos. 1 to 34) are preferably used. The CTL 37 is formed by dissolving the CTM, compound having an alkylamino group and optionally a binder resin in a proper solvent to prepare a coating liquid, coating the coating liquid on the CGL 35 and drying the coating liquid.

Specific examples of the binder resin include thermoplastic resins, thermosetting resins such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like.

When a photosensitive layer is formed of the CGL 35 and CTL 37, and the CTM and compound having an alkylamino group are included in the CTL 37, a total content of the CTM and compound having an alkylamino group is preferably from 20 to 300 parts by weight, and more preferably from 40 to 150 parts by weight per 100 parts by weight of the binder resin. The CTL preferably has a thickness not greater than 25 μm in view of resolution of the resultant images and response. The lower limit of the thickness is preferably not less than 5 μm, although it depends on the image forming system (particularly on a charged potential of the electrophotographic photoreceptor).

In addition, the content of the compound having an alkylamino group is preferably from 0.01 to 150% by weight based on total weight of the CTM. When less than 0.01% by weight, the durability against the oxidizing gas of the resultant photoreceptor deteriorates. When greater than 150% by weight, the residual potential thereof increases.

In the present invention, an oxidation potential (Eox1) of the compound having an alkylamino group and that (Eox2) of the CTM satisfy the following relationship (I):

$$Eox1-Eox2 \geqq -0.2 \quad \text{(I)}$$

To satisfy the relationship, a compound having an alkylamino group and an oxidation potential (Eox1) which is not far from a fixed oxidation potential (Eox2) of the main CTM is preferably selected. When a threshold, i.e. Eox1−Eox2, is less than −0.2, the compound having an alkylamino group noticeably becomes a trap against the charge transport (hole) and a bright section potential of the resultant electrophotographic photoreceptor becomes large, and therefore the resultant images do not have a contrast.

Specific examples of a solvent for use in forming the CTL 37 include tetrahydrofuran, dioxane, toluene, dichloromethane, monochlorobenzene, dichloroethane, cyclohexanone, methyl ethyl ketone, acetone and the like solvents. The CTM can be used alone or in combination in the solvent.

As an antioxidant is preferably included in the CTL 37 and conventional antioxidants mentioned later can be used, and (c) hydroquinone compounds and (f) hindered amine compounds are effectively used in particular.

However, the antioxidant for use in the CTL has a different purpose from the after-mentioned purpose, and are used to prevent quality alteration of the amine compound of the present invention. Therefore, the antioxidant is preferably included in a CTL coating liquid before the amine compound of the present invention is included therein. The content of the antioxidant is from 0.1 to 200% by weight based on total weight of the amine compound.

The CTL 37 preferably includes a polymer CTM, which has both a binder resin function and a charge transport function, because the resultant CTL 37 has good abrasion resistance. Suitable charge transport polymer materials include known materials. Among these materials, polycarbonate resins having a triarylamine structure in their main chain and/or side chain are preferably used.

The CTL 37 can be formed by coating a coating liquid in which the CTM alone or the CTM and a binder resin are dissolved or dispersed in a proper solvent on the CGL, and drying the liquid. In addition, the CTL may optionally include two or more of additives such as plasticizers, leveling agents and antioxidants.

As a method of coating the thus prepared coating liquid, a conventional coating method such as a dip coating method, a spray coating method, a bead coating method, a nozzle coating method, a spinner coating method and a ring coating method can be used.

Next, a single-layered photosensitive layer will be explained. A photoreceptor in which the above-mentioned CGM is dispersed in the binder resin can be used. The photosensitive layer can be formed by coating a coating liquid in which a CGM, a CTM and a binder resin are dissolved or dispersed in a proper solvent, and then drying the coated liquid. In addition, the photosensitive layer may optionally include additives such as plasticizers, leveling agents and antioxidants.

Suitable binder resins include the resins mentioned above in the CTL 37. The resins mentioned above in the CGL 35 can be added as a binder resin. In addition, the polymer CTLs mentioned above can be also used as a binder resin preferably. A content of the CGM is preferably from 5 to 40 parts by weight per 100 parts by weight of the binder resin. A total content of the CGM and the compound having an alkylamino group is preferably from 10 to 45 parts by weight, and more preferably from 20 to 30 parts by weight. Further, the compound having an alkylamino group preferably has a content of from 5 to 100% by weight per 100% by weight of the CTM. When less than 5% by weight, the resultant electrophotographic photoreceptor does not have sufficient resistance against the oxidizing gas. When greater than 100% by weight, the residual potential of the resultant electrophotographic photoreceptor due to repeated use increases.

A method of satisfying the above-mentioned relationship (I) between an oxidation potential (Eox1)of the compound having an alkylamino group and that (Eox2) of the CTM when the photosensitive layer is single-layered is the same as that for the above-mentioned photosensitive layer formed of the CGL 35 and CTL 37.

The single-layered photosensitive layer can be formed by coating a coating liquid in which a CGM, a binder resin and a CTM are dissolved or dispersed in a solvent such as tetrahydrofuran, dioxane, dichloroethane, cyclohexane, etc. by a coating method such as a dip coating method, spray coating method, a bead coating method and a ring coating method. The thickness of the photosensitive layer is preferably from 5 to 25 μm.

In the photoreceptor of the present invention, an under coat layer may be formed between the substrate 31 and the photosensitive layer. The undercoat layer includes a resin as a main component. Since a photosensitive layer is typically formed on the undercoat layer by coating a liquid including an organic solvent, the resin in the undercoat layer preferably has good resistance against general organic solvents. Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like. The undercoat layer may include a fine powder of metal oxides such as titanium oxide, silica, alumina, zirconium oxide, tin oxide and indium oxide to prevent occurrence of moiré in the recorded images and to decrease residual potential of the photoreceptor.

The undercoat layer can be formed by coating a coating liquid using a proper solvent and a proper coating method similarly to those for use in formation of the photosensitive layer mentioned above. The undercoat layer may be formed using a silane coupling agent, titanium coupling agent or a chromium coupling agent. In addition, a layer of aluminum oxide which is formed by an anodic oxidation method and a layer of an organic compound such as polyparaxylylene (parylene) or an inorganic compound such as SiO, $SnO_2$, $TiO_2$, ITO or $CeO_2$ which is formed by a vacuum evaporation method is also preferably used as the undercoat layer. The thickness of the undercoat layer is preferably 0 to 5 μm.

In the photoreceptor of the present invention, the protection layer 39 is optionally formed overlying the photosensitive layer. Suitable materials for use in the protection layer 39 include organic compounds having an acid value of from 10 to 400 mgKOH/g such as ABS resins, ACS resins, olefin-vinyl monomer copolymers, chlorinated polyethers, aryl resins, phenolic resins, polyacetal, polyamides, polyester resins, polyamideimide, polyacrylates, polyarylsulfone, polybutylene, polybutylene terephthalate, polycarbonate, polyethersulfone, polyethylene, polyethylene terephthalate, polyimides, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins and the like, because of preventing an increase of residual potential of the resultant photoreceptor. Among these materials, the polycarbonate resin and the polyarylate resin are preferably and effectively used in terms of dispersibility of a filler, decrease of residual potential and coating defect of the resultant photoreceptor.

The protection layer 39 preferably includes a filler for the purpose of improving abrasion resistance thereof. Suitable fillers include highly-insulative fillers having a pH not less than 5 and a dielectric constant not less than 5 such as titanium oxide, alumina, zinc oxide and zirconium oxide.

The protection layer 39 can be formed by dispersing a binder resin, a filler material, etc. in a proper solvent with a ball mill, an attritor, a sand mill or an ultrasonic to prepare a dispersion liquid; coating the dispersion liquid on a photosensitive layer; and drying the dispersion liquid.

As a solvent for use in forming the protection layer, tetrahydrofuran, dioxane, toluene, dichloromethane, monochlorobenzene, dichloroethane, cyclohexanone, methyl ethyl ketone, acetone and the like solvents which are all used in the CTL 37 can be used. However, a high-viscosity solvent is preferably used in dispersion, and a high-volatile solvent is preferably used in coating. When such a solvent as satisfies the conditions is not available, a mixture of two or more of solvents having each property can be used, which occasionally improves dispersibility of the filler and decreases residual potential of the resultant photoreceptor.

Further, the protection layer 39 may include the compound having an alkylamino group of the present invention. A CTM and the compound having an alkylamino group are preferably and effectively included therein to decrease residual potential of the resultant photoreceptor and to improve quality of the resultant images.

As a method of forming the protection layer, a conventional coating method such as a dip coating method, a spray coating method, a bead coating method, a nozzle coating method, a spinner coating method and ring coating method can be used. In particular, the spray coating method is preferably used in terms of coated film uniformity.

In the photoreceptor of the present invention, an intermediate layer may be formed between the photosensitive layer and the protection layer. The intermediate layer includes a resin as a main component. Specific examples of the resin include polyamides, alcohol soluble nylons, water-soluble polyvinyl butyral, polyvinyl butyral, polyvinyl alcohol, and the like. The intermediate layer can be formed by one of the above-mentioned known coating methods. The thickness of the intermediate layer is preferably from 0.05 to 2 μm.

In the photoreceptor of the present invention, antioxidants, plasticizers, lubricants, ultraviolet absorbents and leveling agents can be included in each layer such as the CGL, CTL, undercoat layer, protection layer and intermediate layer for environmental improvement, above all for the purpose of preventing decrease of photosensitivity and increase of residual potential. Such compounds will be shown as follows.

Suitable antioxidants for use in the layers of the photoreceptor include the following compounds but are not limited thereto.

(a) Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidene bis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol compounds, and the like.

(b) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

(c) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and the like.

(d) Organic Sulfur-containing Compounds

Dilauryl-3,3'-thiodipropionate, distearyl-3,3'-thiodipropionate, ditetradecyl-3,3'-thiodipropionate, and the like.

(e) Organic Phosphorus-Containing Compounds

Triphenylphosphine, tri(nonylphenyl)phosphine, tri(dinonylphenyl)phosphine, tricresylphosphine, tri(2,4-dibutylphenoxy)phosphine and the like.

Suitable plasticizers for use in the layers of the photoreceptor include the following compounds but are not limited thereto:

(a) Phosphoric Acid Esters Plasticizers

Triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate, triphenyl phosphate, and the like.

(b) Phthalic Acid Esters Plasticizers

Dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate, and the like.

(c) Aromatic Carboxylic Acid Esters Plasticizers

Trioctyl trimellitate, tri-n-octyl trimellitate, octyl oxybenzoate, and the like.

(d) Dibasic Fatty Acid Esters Plasticizers

Dibutyl adipate, di-n-hexyl adipate, di-2-ethylhexyl adipate, di-n-octyl adipate, n-octyl-n-decyl adipate, diisodecyl adipate, dialkyl adipate, dicapryl adipate, di-2-etylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, and the like.

(e) Fatty Acid Ester Derivatives

Butyl oleate, glycerin monooleate, methyl acetylricinolate, pentaerythritol esters, dipentaerythritol hexaesters, triacetin, tributyrin, and the like.

(f) Oxyacid Esters Plasticizers

Methyl acetylricinolate, butyl acetylricinolate, butylphthalylbutyl glycolate, tributyl acetylcitrate, and the like.

(g) Epoxy Plasticizers

Epoxydized soybean oil, epoxydized linseed oil, butyl epoxystearate, decyl epoxystearate, octyl epoxystearate, benzyl epoxystearate, dioctyl epoxyhexahydrophthalate, didecyl epoxyhexahydrophthalate, and the like.

(h) Dihydric Alcohol Esters Plasticizers

Diethylene glycol dibenzoate, triethylene glycol di-2-ethylbutyrate, and the like.

(i) Chlorine-containing Plasticizers

Chlorinated paraffin, chlorinated diphenyl, methyl esters of chlorinated fatty acids, methyl esters of methoxychlorinated fatty acids, and the like.

(j) Polyester Plasticizers

Polypropylene adipate, polypropylene sebacate, acetylated polyesters, and the like.

(k) Sulfonic Acid Derivatives

P-toluene sulfonamide, o-toluene sulfonamide, p-toluene sulfoneethylamide, o-toluene sulfoneethylamide, toluene sulfone-N-ethylamide, p-toluene sulfone-N-cyclohexylamide, and the like.

(l) Citric Acid Derivatives

Triethyl citrate, triethyl acetylcitrate, tributyl citrate, tributyl acetylcitrate, tri-2-ethylhexyl acetylcitrate, n-octyldecyl acetylcitrate, and the like.

(m) Other Compounds

Terphenyl, partially hydrated terphenyl, camphor, 2-nitro diphenyl, dinonyl naphthalene, methyl abietate, and the like.

Suitable lubricants for use in the layers of the photoreceptor include the following compounds but are not limited thereto.

(a) Hydrocarbon Compounds

Liquid paraffins, paraffin waxes, micro waxes, low molecular weight polyethylenes, and the like.

(b) Fatty Acid Compounds

Lauric acid, myristic acid, palmitic acid, stearic acid, arachidic acid, behenic acid, and the like.

(c) Fatty Acid Amide Compounds

Stearic acid amide, palmitic acid amide, oleic acid amide, methylenebisstearamide, ethylenebisstearamide, and the like.

(d) Ester Compounds

Lower alcohol esters of fatty acids, polyhydric alcohol esters of fatty acids, polyglycol esters of fatty acids, and the like.

(e) Alcohol Compounds

Cetyl alcohol, stearyl alcohol, ethylene glycol, polyethylene glycol, polyglycerol, and the like.

(f) Metallic Soaps

Lead stearate, cadmium stearate, barium stearate, calcium stearate, zinc stearate, magnesium stearate, and the like.

(g) Natural Waxes

Carnauba wax, candelilla wax, beeswax, spermaceti, insect wax, montan wax, and the like.

(h) Other Compounds

Silicone compounds, fluorine compounds, and the like.

Suitable ultraviolet absorbing agents for use in the layers of the photoreceptor include the following compounds but are not limited thereto.

(a) Benzophenone Compounds 2-hydroxybenzophenone, 2,4-dihydroxybenzophenone, 2,2',4-trihydroxybenzophenone, 2,2',4,4'-tetrahydroxybenzophenone, 2,2'-dihydroxy-4-methoxybenzophenone, and the like.

(b) Salicylate Compounds

Phenyl salicylate, 2,4-di-t-butylphenyl-3,5-di-t-butyl-4-hydroxybenzoate, and the like.

(c) Benzotriazole Compounds (2'-hydroxyphenyl)benzotriazole, (2'-hydroxy-5'-methylphenyl)benzotriazole and (2'-hydroxy-3'-t-butyl-5'-methylphenyl)-5-chlorobenzotriazole.

(d) Cyano Acrylate Compounds

Ethyl-2-cyano-3,3-diphenyl acrylate, methyl-2-carbomethoxy-3-(paramethoxy) acrylate, and the like.

(e) Quenchers (Metal Complexes)

Nickel(2,2'-thiobis(4-t-octyl)phenolate)-n-butylamine, nickeldibutyldithiocarbamate, cobaltdicyclohexyldithiophosphate, and the like.

(f) HALS (Hindered Amines)

Bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetrametylpyridine, 8-benzyl-7,7,9,9-tetramethyl-3-octyl-1,3,8-triazaspiro[4,5]undecane-2,4-dione, 4-benzoyloxy-2,2,6,6-tetramethylpiperidine, and the like.

Next, the image forming method and apparatus of the present invention will be explained, referring to drawings. Specifically, the image forming method typified by an electrophotographic image forming method and the image forming apparatus typified by an electrophotographic image forming apparatus will be explained.

Figure 6:
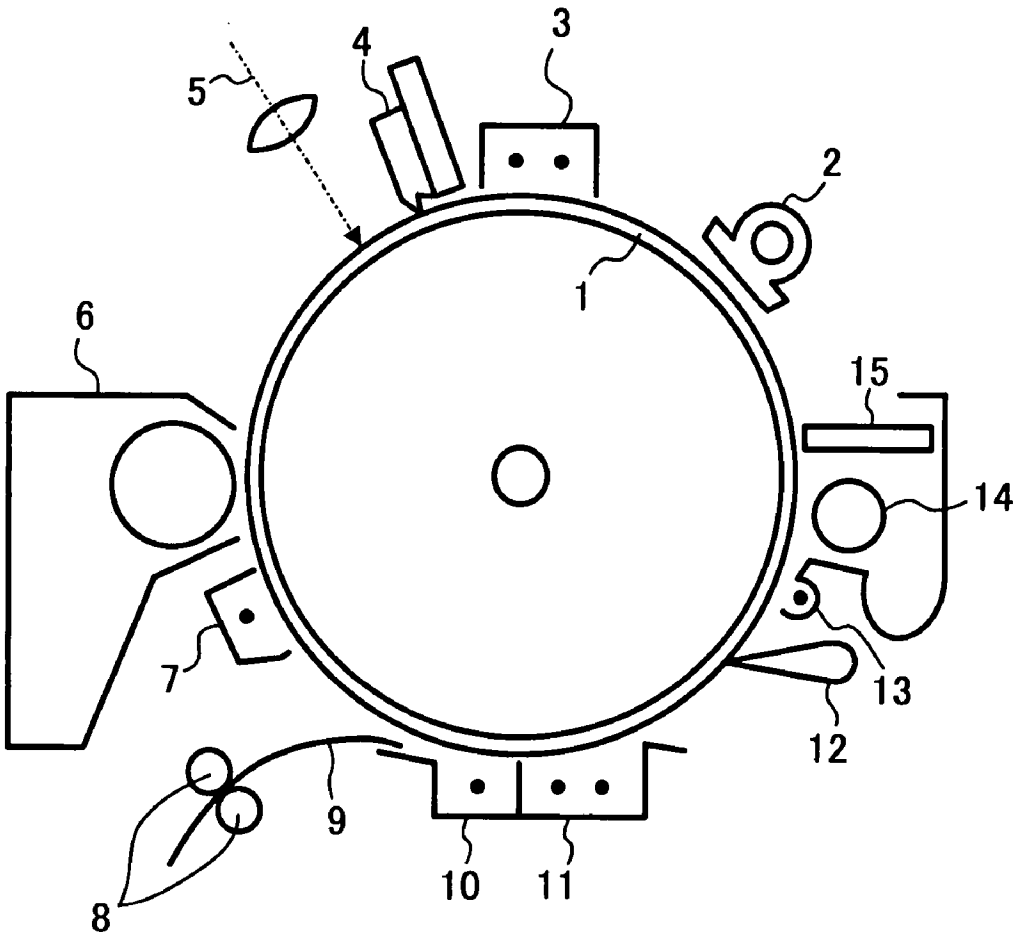
FIG. 6 is a schematic view illustrating a partial cross-section of an embodiment of the electrophotographic image forming apparatus of the present invention.

FIG. 6 is a schematic view for explaining the electrophotographic method and apparatus of the present invention, and a modified embodiment as mentioned below belongs to the present invention.

In FIG. 6, a photoreceptor 1 includes at least a photosensitive layer and the most surface layer includes a filler. The photoreceptor 1 is drum-shaped, and may be sheet-shaped or endless-belt shaped. Any known chargers such as a corotron, a scorotron, a solid state charger and a charging roller can be used for a charger 3, a pre-transfer charger 7, a transfer charge 10, a separation charger 11 and a pre-cleaning charger 13.

The above-mentioned chargers can be used as transfer means, and typically a combination of the transfer charger and the separation charger is effectively used.

Suitable light sources for use in the imagewise light irradiating device 5 and the discharging lamp 2 include fluorescent lamps, tungsten lamps, halogen lamps, mercury lamps, sodium lamps, light emitting diodes (LEDs), laser diodes (LDs), light sources using electroluminescence (EL) and the like. In addition, in order to obtain light having a desired wave length range, filters such as sharp-cut filters, band pass filters, near-infrared cutting filters, dichroic filters, interference filters, color temperature converting filters and the like can be used.

The above-mentioned light sources can be used for not only the processes mentioned above and illustrated in FIG. 6, but also other processes, such as a transfer process, a discharging process, a cleaning process, a pre-exposure process, which include light irradiation to the photoreceptor.

When the toner image formed on the photoreceptor 1 by a developing unit 6 is transferred onto a transfer sheet 9, all of the toner image are not transferred thereon, and residual toner particles remain on the surface of the photoreceptor 1. The residual toner is removed from the photoreceptor by a fur brush 14 and a blade 15. The residual toner remaining on the photo receptor 1 can be removed by only a cleaning brush. Suitable cleaning brushes include known cleaning brushes such as fur brushes and mag-fur brushes.

When the photoreceptor which is previously charged positively is exposed to imagewise light, an electrostatic latent image having a positive or negative charge is formed on the photoreceptor. When the latent image having a positive charge is developed with a toner having a negative charge, a positive image can be obtained. In contrast, when the latent image having a positive charge is developed with a toner-having a positive charge, a negative image (i.e., a reversal image) can be obtained.

As the developing method, known developing methods can be used. In addition, as the discharging methods, known discharging methods can be also used.

Figure 7:
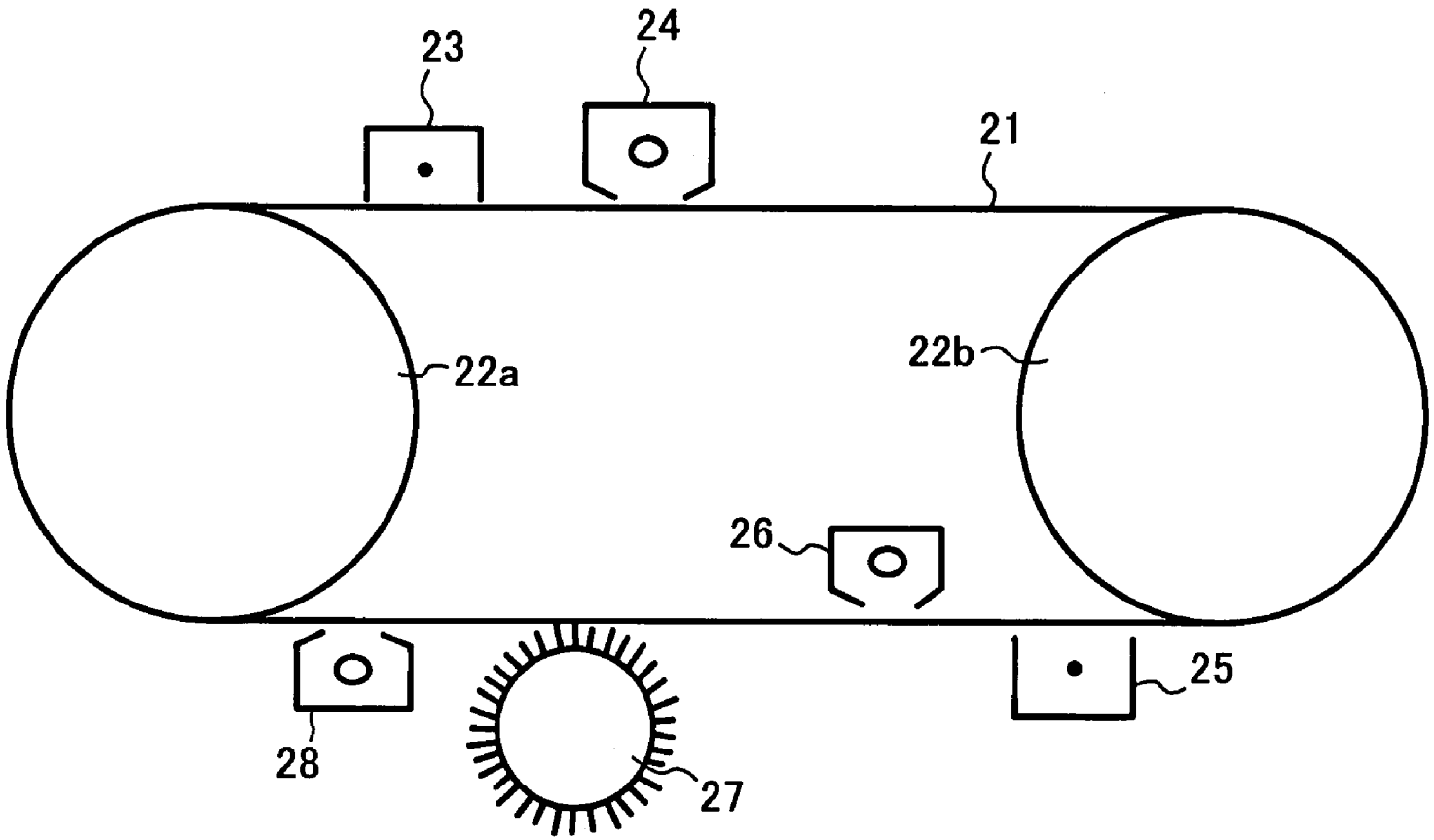
FIG. 7 is a schematic view for explaining an embodiment of the electrophotographic image forming process of the present invention.

FIG. 7 is a schematic view for explaining another embodiment of the electrophotographic apparatus and method of the present invention. A photoreceptor 21 includes at least a photosensitive layer and the most surface layer includes a filler. The photoreceptor is rotated by rollers 22*a* and 22*b*. Charging using a charger 23, imagewise exposure using an imagewise light irradiating device 24, developing using a developing unit (not shown), transferring using a transfer charger 25, pre-cleaning using a light source 26, cleaning using a cleaning brush 27 and discharging using a discharging light source 28 are repeatedly performed. In FIG. 7, the pre-cleaning light irradiating is performed from the side of the substrate of the photoreceptor 21. In this case, the substrate has to be light-transmissive.

The image forming apparatus of the present invention is not limited to the image forming units as shown in FIGS. 6 and 7. For example, although the pre-cleaning light irradiation is performed from the substrate side in FIG. 7, the pre-cleaning light irradiating operation can be performed from the photosensitive layer side of the photoreceptor. In addition, the light irradiation in the light image irradiating process and the discharging process may be performed from the substrate side of the photoreceptor.

As light irradiation processes, the imagewise irradiation process, pre-cleaning irradiation process, and discharging light irradiation are illustrated. In addition, a pre-transfer light irradiation and a preliminary light irradiation before the imagewise light irradiation, and other known light irradiation processes may also be performed on the photoreceptor.

Figure 8:
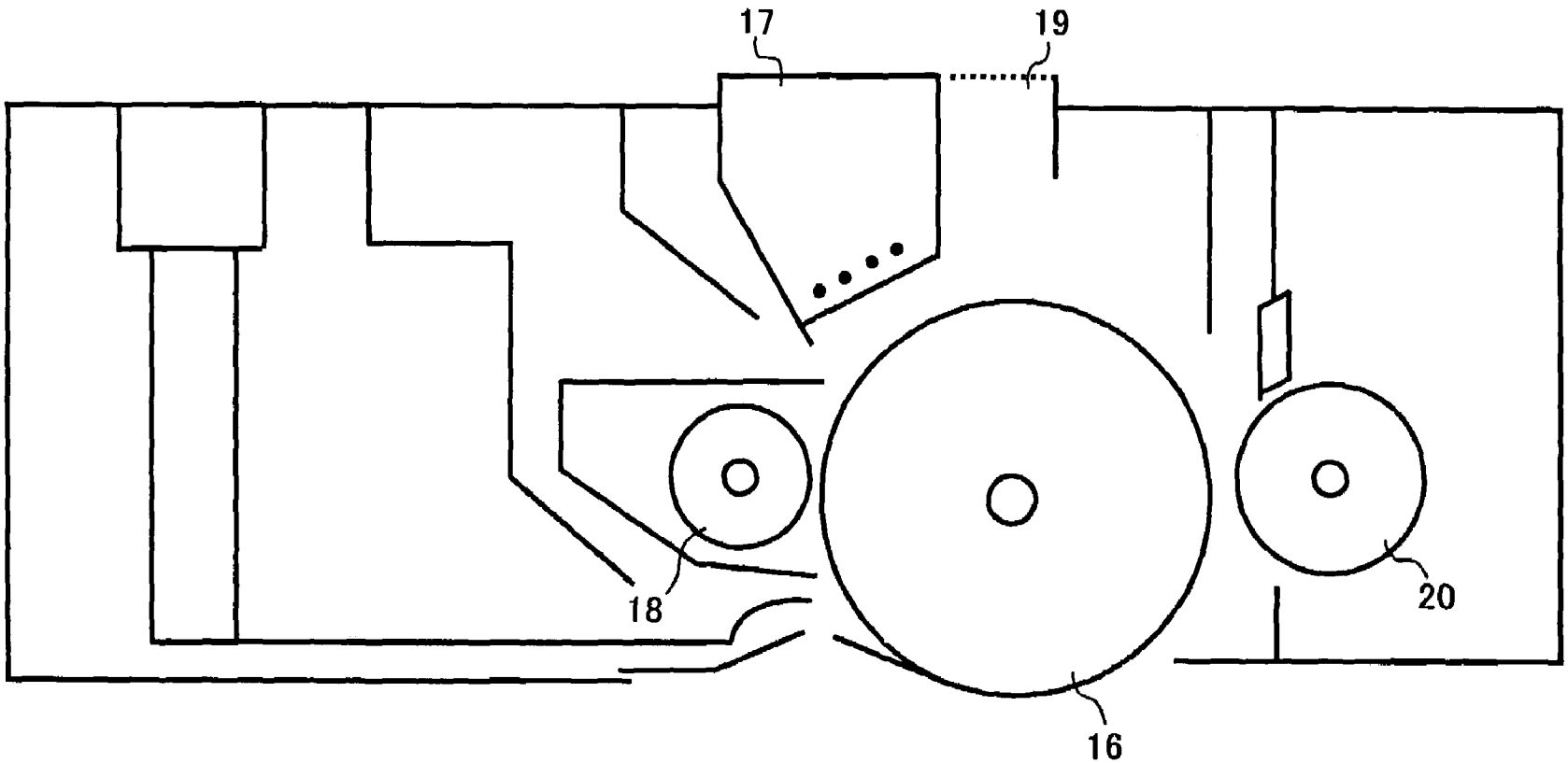
FIG. 8 is a schematic view illustrating a cross-section of an embodiment of the process cartridge of the present invention.

The above-mentioned image forming unit may be fixedly set in a copier, a facsimile or a printer. However, the image forming unit may be set therein as a process cartridge. The process cartridge means an image forming unit (or device) which includes a photoreceptor, a charger, an imagewise light irradiator, an image developer, an image transferer, a cleaner, and a discharger. Various process cartridges can be used in the present invention. FIG. 8 illustrates an embodiment of the process cartridge.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Examples 1 to 26 and Comparative Examples 1 to 8

An undercoat coating liquid, a charge generation coating liquid and charge transport coating liquid, which have the following formulations, were coated in this order on an aluminium cylinder by a dip coating method and dried to prepare photoreceptors 1 to 34 having an undercoat layer of 3.5 μm thick, a CGL of 0.2 μm thick, a CTL of 23 μm thick.

| Undercoat layer coating liquid | |
|---|---|
| Titanium dioxide powder | 400 |
| Melamine resin | 65 |
| Alkyd resin | 120 |
| 2-butanone | 400 |
| CGL coating liquid | |
| Fluorenone bisazo pigment having the following formula (68) | 12 |

-continued
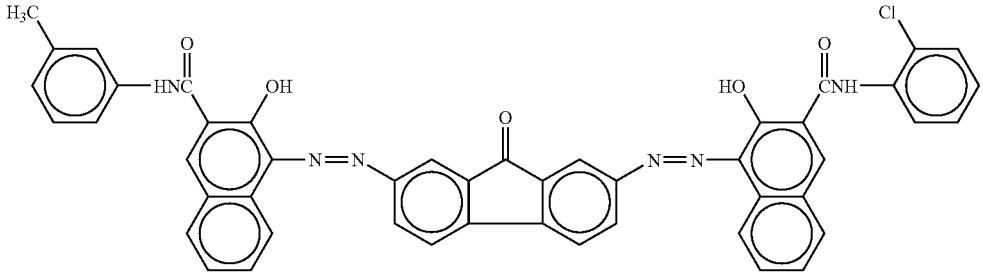
(68)
| | |
|---|---|
| Polyvinyl butyral | 5 |
| 2-butanone | 200 |
| Cyclohexanone | 400 |
CTL coating liquid
| | |
|---|---|
| Polycarbonate resin | 10 |
| (Z polyca from Teijin Chemicals Ltd.) | |
| The compounds having an alkylamino group | 1 |
| No. 1 to 34 | |
| CTM having the following formula (69) | 9 |
| and an oxidation potential of 0.76 | |
| (V vs. SCE) | |
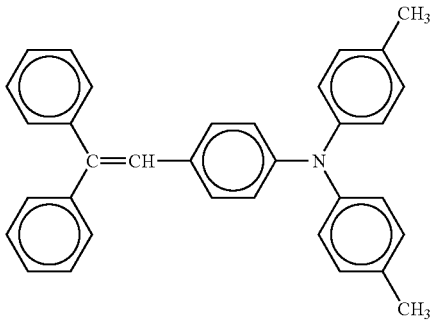
(69)
| | |
|---|---|
| Tetrahydrofuran | 100 |

Figure 9:
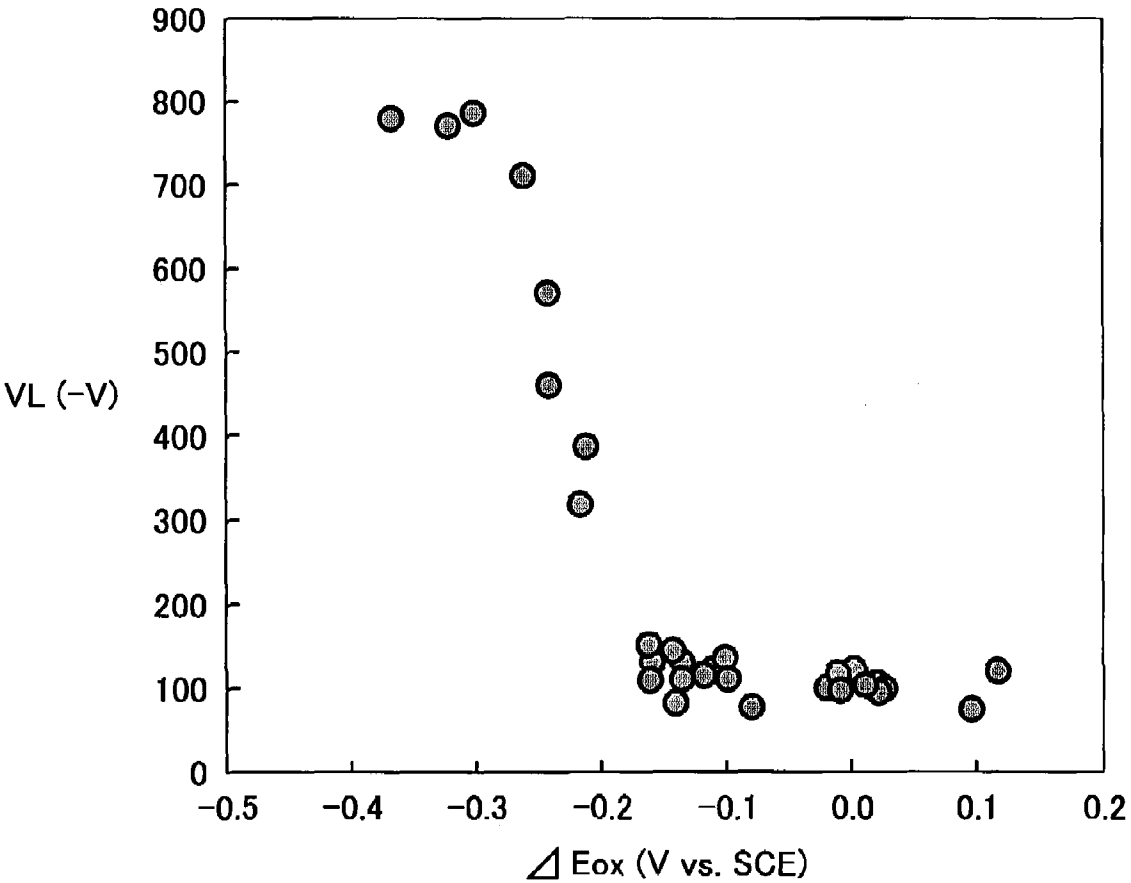
FIG. 9 is a chart showing a relationship between a difference (Δ E) between the oxidation potential of the compound having an alkylamino group and that of a CTM, and a bright section potential (VL) in the electrophotographic photoreceptor of the present invention.

After the thus prepared each photoreceptor 1 to 34 was installed in a process cartridge for electrophotography and the cartridge was installed in a modified copier imagio MF2200 from Ricoh Company, ltd. having a scorotron type corona charger an imagewise light source of a LD having a wavelength of 655 nm, in which the photoreceptor had a dark portion potential of 800 (−V) and an image surface illuminance of 0.45 (μj/cm$^2$), a bright portion potential was measured. Further, 100,000 images were continuosly produced, and the initial image and the image after 100,000 images were produced were evaluated. The results are shown in Table 1. In addition, a graph in which a difference (Δ E) between an oxidation potential of the compound having an alkylamino group and that of the CTM and the initial bright portion potential (VL) of the photoreceptor are plotted is shown in FIG. 9.

TABLE 1

| | No. of compound | ΔE (V vs. SCE) | Initial VL (−V) | Initial Image quality | After 100,000 Image quality |
|---|---|---|---|---|---|
| Com. Ex. 1 | 1 | −0.240 | 479 | Low image density | Low image density |
| Ex. 1 | 2 | −0.155 | 133 | Good | Good |
| Com. Ex. 2 | 3 | −0.260 | 709 | Image was not produced | — |
| Com. Ex. 3 | 4 | −0.320 | 769 | Image was not produced | — |
| Ex. 2 | 5 | −0.105 | 117 | Good | Good |
| Com. Ex. 4 | 6 | −0.240 | 571 | Image was not produced | — |
| Com. Ex. 5 | 7 | −0.210 | 385 | Low image density | Low image density |
| Ex. 3 | 8 | −0.110 | 124 | Good | Good |
| Ex. 4 | 9 | −0.120 | 115 | Good | Good |
| Ex. 5 | 10 | −0.100 | 113 | Good | Good |
| Ex. 6 | 11 | −0.100 | 130 | Good | Good |
| Ex. 7 | 12 | −0.135 | 112 | Good | Good |
| Ex. 8 | 13 | 0.115 | 120 | Good | Good |
| Ex. 9 | 14 | −0.100 | 102 | Good | Good |
| Ex. 10 | 15 | 0.020 | 105 | Good | Good |
| Ex. 11 | 16 | −0.010 | 115 | Good | Good |

TABLE 1-continued

| | No. of compound | ΔE (V vs. SCE) | Initial VL (−V) | Initial Image quality | After 100,000 Image quality |
|---|---|---|---|---|---|
| Ex. 12 | 17 | −0.160 | 150 | Good | Good |
| Ex. 13 | 18 | −0.135 | 131 | Good | Good |
| Com. Ex. 6 | 19 | −0.365 | 780 | Image was not produced | — |
| Ex. 14 | 20 | −0.100 | 105 | Good | Good |
| Ex. 15 | 21 | −0.140 | 113 | Good | Good |
| Com. Ex. 7 | 22 | −0.215 | 318 | Good | Low image density |
| Ex. 16 | 23 | 0.000 | 122 | Good | Good |
| Com. Ex. 8 | 24 | −0.300 | 785 | Image was not produced | — |
| Ex. 17 | 25 | 0.025 | 101 | Good | Good |
| Ex. 18 | 26 | −0.020 | 101 | Good | Good |
| Ex. 19 | 27 | −0.010 | 96 | Good | Good |
| Ex. 20 | 28 | −0.160 | 109 | Good | Good |
| Ex. 21 | 29 | 0.095 | 76 | Good | Good |
| Ex. 22 | 30 | −0.080 | 78 | Good | Good |
| Ex. 23 | 31 | −0.140 | 83 | Good | Good |
| Ex. 24 | 32 | −0.010 | 102 | Good | Good |
| Ex. 25 | 33 | 0.020 | 95 | Good | Good |
| Ex. 26 | 34 | 0.010 | 105 | Good | Good |

Examples 27 to 52 and Comparative Examples 9 to 16

Figure 10:
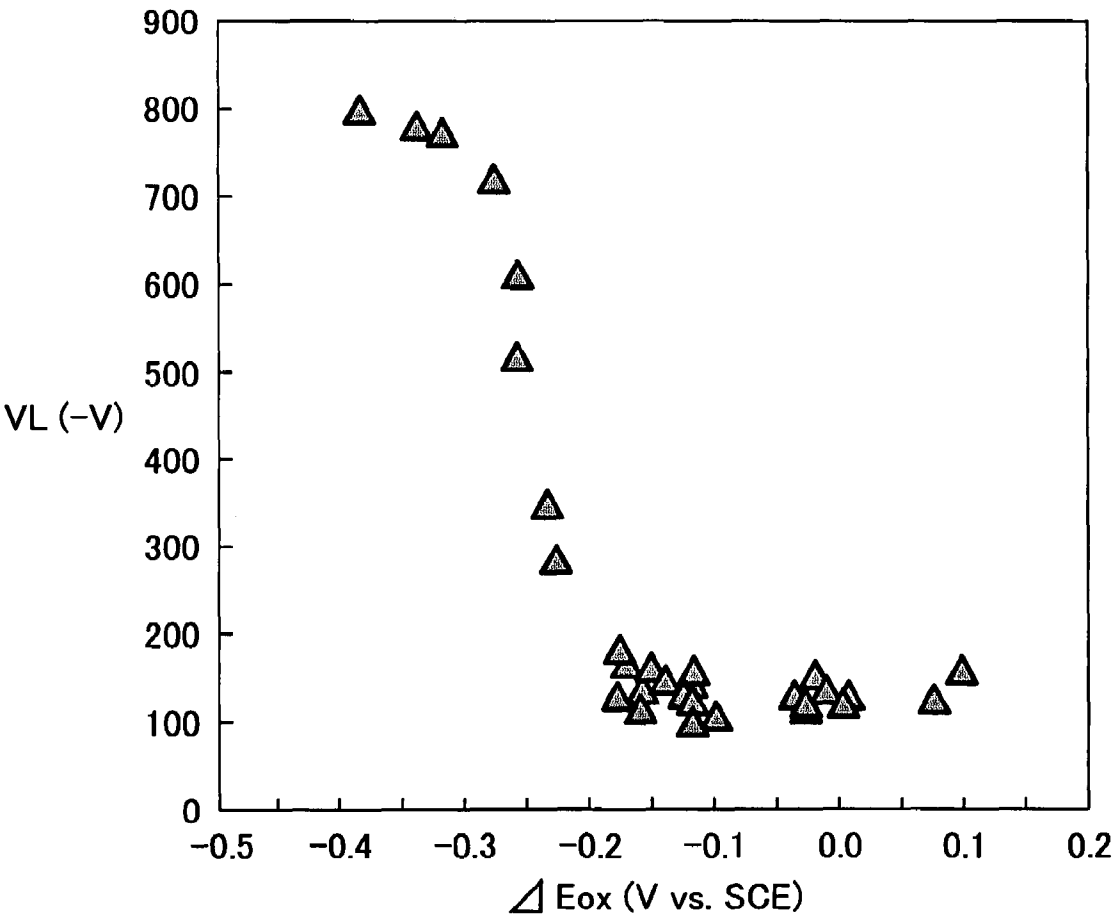
FIG. 10 is a chart showing a relationship between a difference (Δ E) between the oxidation potential of the compound having an alkylamino group and that of another CTM, and a bright section potential (VL) in the electrophotographic photoreceptor of the present invention.

The procedures for preparation and evaluation of the photoreceptor in Example 1 were repeated to prepare and evaluate photoreceptors 35 to 68 except for changing 9 parts of the CTM and 10 parts of the polycarbonate resin included in the CTL binder resin to 19 parts of a charge transport polymer material having the following formula (70) and an oxidation potential of 0.780 (V. vs. SCE). The results are shown in Table 2 and FIG. 10.

TABLE 2

(70)

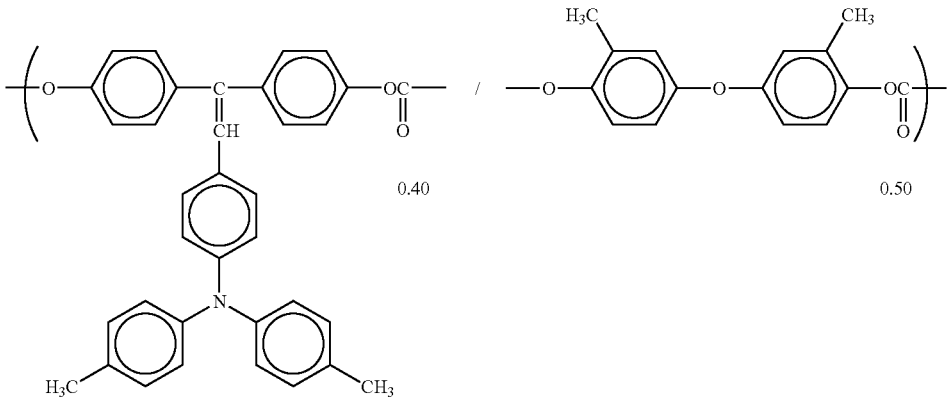

| | No. of compound | ΔE (V vs. SCE) | Initial VL (−V) | Initial Image quality | After 100,000 Image quality |
|---|---|---|---|---|---|
| Com. Ex. 9 | 1 | −0.260 | 519 | Low image density | Image was not produced |
| Ex. 27 | 2 | −0.175 | 168 | Good | Good |
| Com. Ex. 10 | 3 | −0.260 | 719 | Image was not produced | — |
| Com. Ex. 11 | 4 | −0.280 | 779 | Image was not produced | — |
| Ex. 28 | 5 | −0.340 | 137 | Good | Good |
| Com. Ex. 12 | 6 | −0.125 | 611 | Image was not produced | — |
| Com. Ex. 13 | 7 | −0.260 | 285 | Good | Low image density |
| Ex. 29 | 8 | −0.230 | 134 | Good | Good |
| Ex. 30 | 9 | −0.130 | 147 | Good | Good |
| Ex. 31 | 10 | −0.140 | 143 | Good | Good |
| Ex. 32 | 11 | −0.120 | 160 | Good | Good |
| Ex. 33 | 12 | −0.120 | 147 | Good | Good |
| Ex. 34 | 13 | −0.155 | 160 | Good | Good |
| Ex. 35 | 14 | −0.120 | 102 | Good | Good |
| Ex. 36 | 15 | 0.000 | 125 | Good | Good |
| Ex. 37 | 16 | −0.030 | 130 | Good | Good |
| Ex. 38 | 17 | −0.180 | 180 | Good | Good |
| Ex. 39 | 18 | −0.155 | 161 | Good | Good |
| Com. Ex. 14 | 19 | −0.385 | 800 | Image was not produced | — |

TABLE 2-continued

| | | | | | |
|---|---|---|---|---|---|
| | 20 | −0.120 | 123 | | Good |
| Ex. 40 | | | | Good | |
| | 21 | −0.160 | 137 | | Good |
| Ex. 41 | | | | Good | |
| | 22 | −0.235 | 349 | | Low image |
| Com. Ex. 15 | | | | Good | density |
| | 23 | −0.020 | 152 | | Good |
| Ex. 42 | | | | Good | |
| | 24 | −0.320 | 772 | | — |
| Com. Ex. 16 | | | | Image was not produced | |
| | 25 | 0.005 | 131 | | Good |
| Ex. 43 | | | | Good | |
| | 26 | −0.040 | 131 | | Good |
| Ex. 44 | | | | Good | |
| | 27 | −0.030 | 122 | | Good |
| Ex. 45 | | | | Good | |
| | 28 | −0.180 | 129 | | Good |
| Ex. 46 | | | | Good | |
| | 29 | 0.075 | 128 | | Good |
| Ex. 47 | | | | Good | |
| | 30 | −0.100 | 106 | | Good |
| Ex. 48 | | | | Good | |
| | 31 | −0.160 | 113 | | Good |
| Ex. 49 | | | | Good | |
| | 32 | −0.030 | 113 | | Good |
| Ex. 50 | | | | Good | |
| | 33 | 0.000 | 121 | | Good |
| Ex. 51 | | | | Good | |
| | 34 | −0.010 | 135 | | Good |
| Ex. 52 | | | | Good | |

Examples 53 to 83 and Comparative Examples 17 to 19

Figure 12:
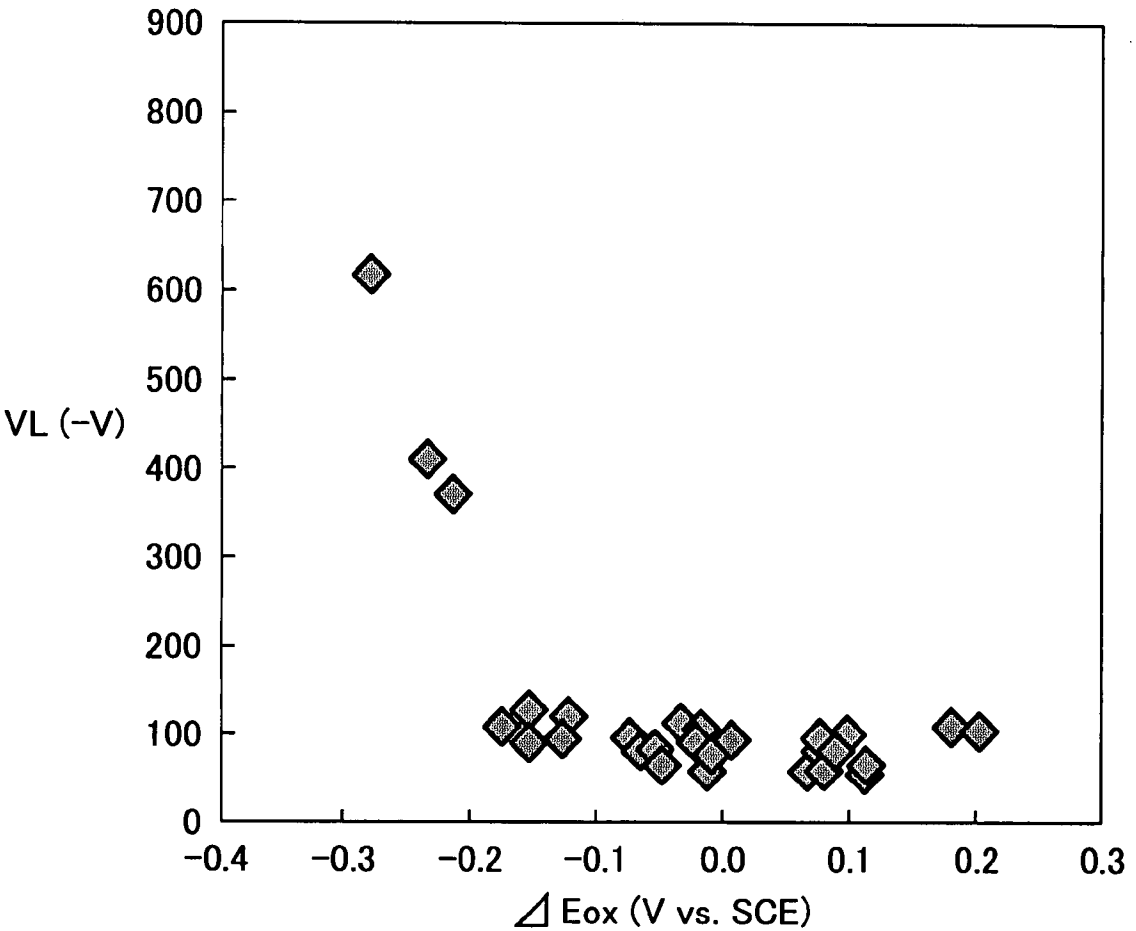
FIG. 12 is a chart showing a relationship between a difference (Δ E) between the oxidation potential of the compound having an alkylamino group and that of a third CTM, and a bright section potential (VL) in the electrophotographic photoreceptor of the present invention.

The procedures for preparation and evaluation of the photoreceptor in Example 1 were repeated to prepare and evaluate photoreceptors 69 to 102 except for changing the CGL coating liquid and CTL coating liquid to a CGL coating liquid and a CTL coating liquid having the following formulations respectively. The results are shown in Table 3 and FIG. 12.

TABLE 3

Figure 11:
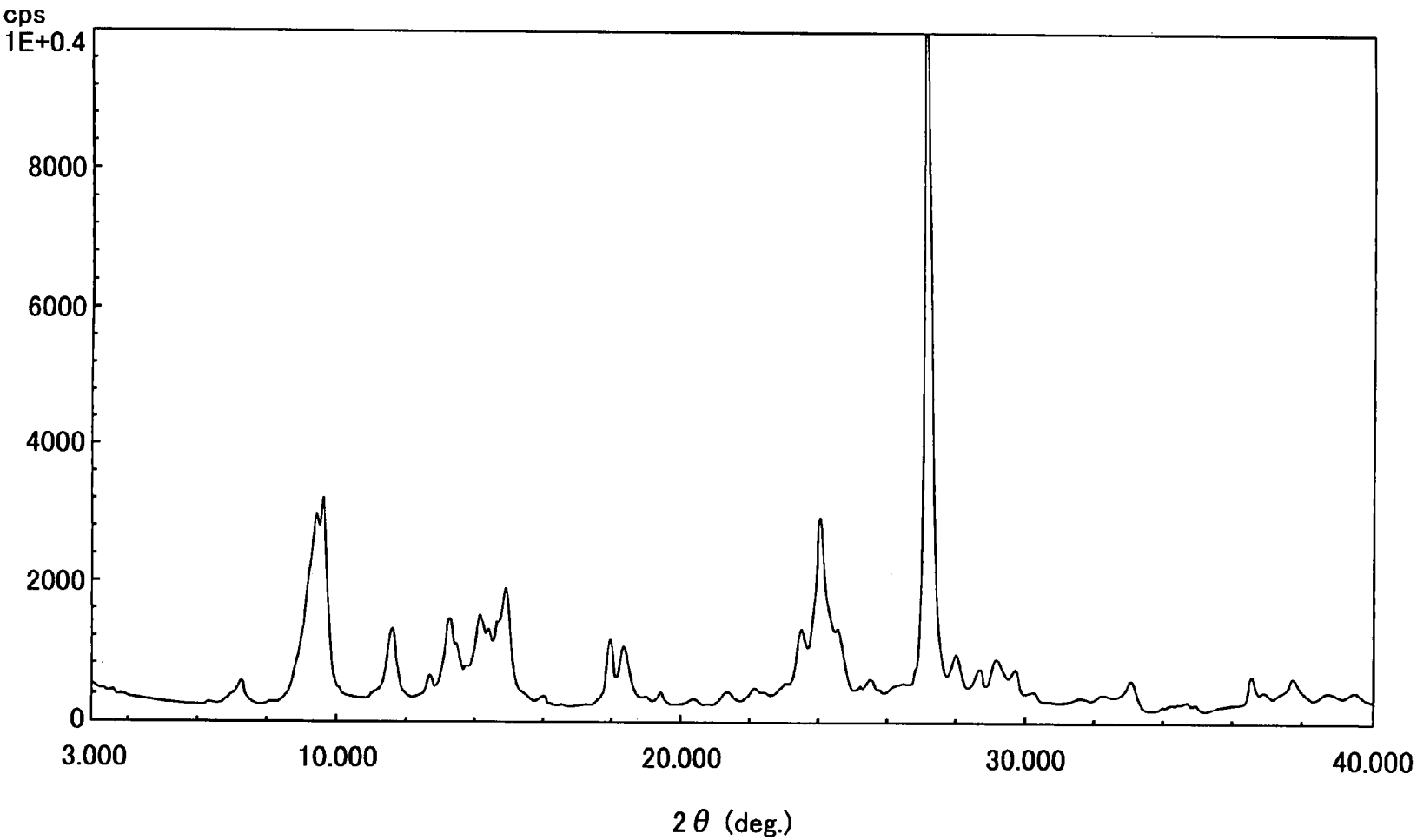
FIG. 11 is a chart showing a XD spectrum of an oxotitaniumphthalocyanine powder of the present invention.

| | |
|---|---|
| CGL coating liquid | |
| | 8 |
| Oxotitaniumphthalocyanine | |
| having the powder XD spectrum in FIG. 11 | 5 |
| Polyvinylbutyral | 400 |
| 2-butanone | |
| CTL coating liquid | |
| | 10 |
| Polycarbonate resin | |
| (Z polyca from Teijin Chemicals Ltd.) | |

TABLE 3-continued

| | |
|---|---|
| | 1 |
| The compounds having an alkylamino group | |
| No. 1 to 34 | |
| | 7 |
| CTM having the following formula (71) | |
| and an oxidation potential of 0.675 | |
| (V vs. SCE) | |

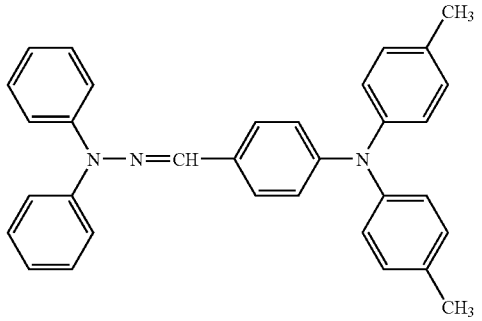

(71)

TABLE 3-continued

| | No. of compound | $\Delta_E$ (V vs. SCE) | Initial VL (−V) | Initial Image quality | After 100,000 Image quality |
|---|---|---|---|---|---|
| Toluene | | | | | |
| | 1 | −0.155 | 94 | Good | Good |
| Ex. 53 | | | | | |
| | 2 | −0.070 | 82 | Good | Good |
| Ex. 54 | | | | | |
| | 3 | −0.175 | 112 | Good | Good |
| Ex. 55 | | | | | |
| | 4 | −0.235 | 423 | Low image density | Low image density |
| Com. Ex. 17 | | | | | |
| | 5 | −0.020 | 108 | Good | Good |
| Ex. 56 | | | | | |
| | 6 | −0.155 | 129 | Good | Good |
| Ex. 57 | | | | | |
| | 7 | −0.125 | 123 | Good | Good |
| Ex. 58 | | | | | |
| | 8 | −0.025 | 956 | Good | Good |
| Ex. 59 | | | | | |
| | 9 | −0.035 | 116 | Good | Good |
| Ex. 60 | | | | | |
| | 10 | −0.015 | 94 | Good | Good |
| Ex. 61 | | | | | |
| | 11 | −0.015 | 78 | Good | Good |
| Ex. 62 | | | | | |
| | 12 | −0.050 | 65 | Good | Good |
| Ex. 63 | | | | | |
| | 13 | 0.200 | 105 | Good | Good |
| Ex. 64 | | | | | |
| | 14 | −0.015 | 83 | Good | Good |
| Ex. 65 | | | | | |
| | 15 | 0.105 | 64 | Good | Good |
| Ex. 66 | | | | | |
| | 16 | 0.075 | 58 | Good | Good |
| Ex. 67 | | | | | |
| | 17 | −0.075 | 101 | Good | Good |
| Ex. 68 | | | | | |
| | 18 | −0.050 | 73 | Good | Good |
| Ex. 69 | | | | | |
| | 19 | −0.280 | 633 | Image was not produced | — |
| Com. Ex. 18 | | | | | |
| | 20 | −0.015 | 58 | Good | Good |
| Ex. 70 | | | | | |
| | 21 | −0.055 | 87 | Good | Good |
| Ex. 71 | | | | | |
| | 22 | −0.130 | 97 | Good | Low image density |
| Ex. 72 | | | | | |
| | 23 | 0.085 | 81 | Good | Good |
| Ex. 73 | | | | | |
| | 24 | −0.215 | 382 | Low image density | Low image density |
| Com. Ex. 19 | | | | | |
| | 25 | 0.110 | 68 | Good | Good |
| Ex. 74 | | | | | |
| | 26 | 0.065 | 60 | Good | Good |
| Ex. 75 | | | | | |
| | 27 | 0.075 | 100 | Good | Good |
| Ex. 76 | | | | | |
| | 28 | −0.075 | 95 | Good | Good |
| Ex. 77 | | | | | |
| | 29 | 0.180 | 110 | Good | Good |
| Ex. 78 | | | | | |
| | 30 | 0.005 | 97 | Good | Good |
| Ex. 79 | | | | | |
| | 31 | −0.055 | 73 | Good | Good |
| Ex. 80 | | | | | |
| | 32 | 0.075 | 85 | Good | Good |
| Ex. 81 | | | | | |
| | 33 | 0.105 | 55 | Good | Good |
| Ex. 82 | | | | | |
| | 34 | 0.095 | 102 | Good | Good |
| Ex. 83 | | | | | |

Examples 84 to 109 and Comparative Examples 20 to 27

An undercoat coating liquid, a charge generation coating liquid and charge transport coating liquid, which have the following formulations, were coated in this order on an aluminium cylinder by a dip coating method and dried form an undercoat layer of 3.5 μm thick, a CGL of 0.2 μm thick, a CTL of 23 μm thick on the aluminium cylinder.

Figure 13:
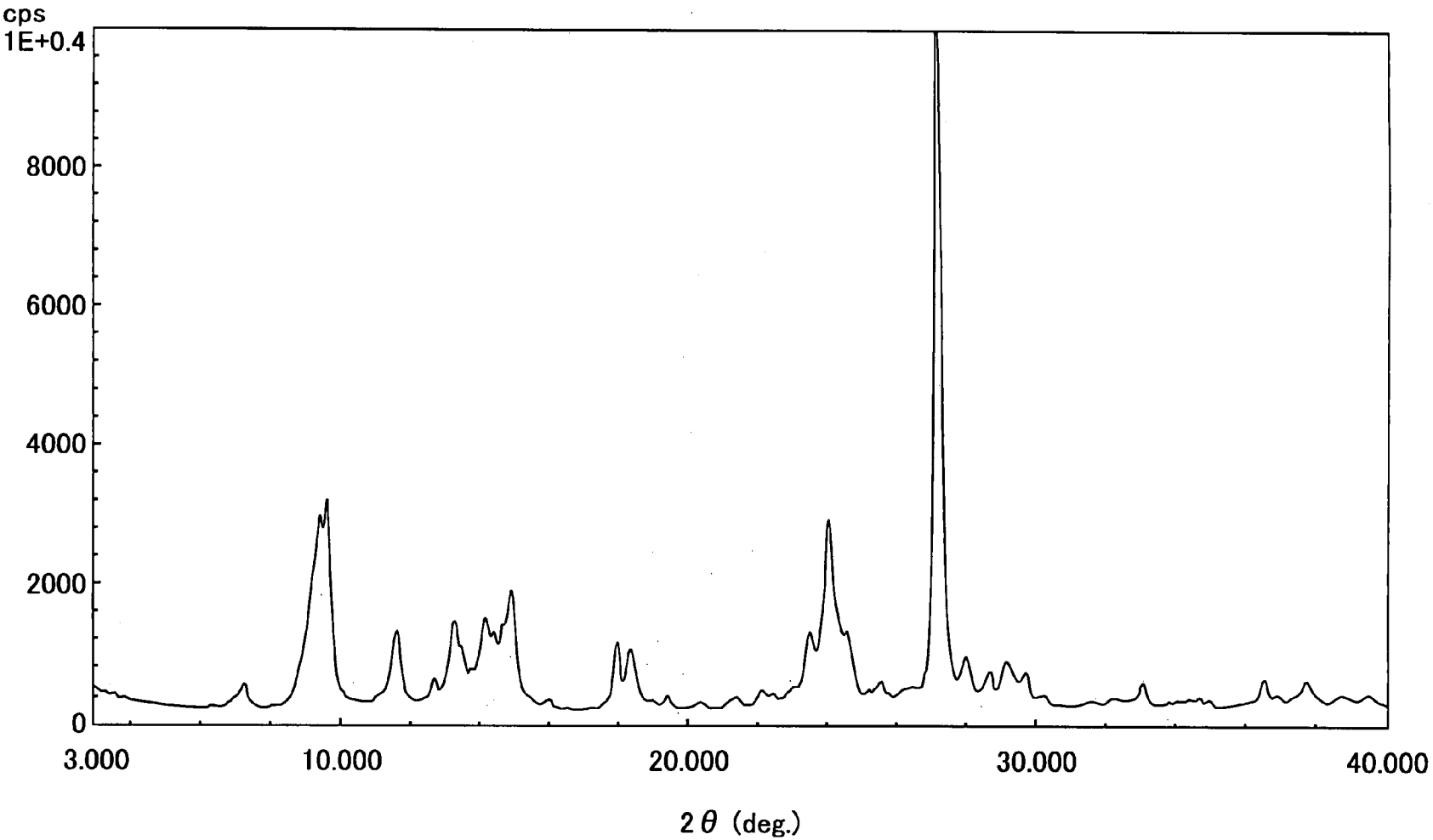
FIG. 13 is a chart showing a XD spectrum of another oxotitaniumphthalocyanine powder of the present invention.

| | |
|---|---|
| Undercoat layer coating liquid | |
| Titanium dioxide powder | 400 |
| Melamine resin | 65 |
| Alkyd resin | 120 |
| 2-butanone | 400 |
| CGL coating liquid | |
| Oxotitaniumphthalocyanine having the powder XD spectrum in FIG. 13 | 8 |
| Polyvinylbutyral | 5 |
| 2-butanone | 400 |
| CTL coating liquid | |
| Polycarbonate resin (Z polyca from Teijin Chemicals Ltd.) | 10 |
| CTM having the following formula (72) | 9 |

-continued

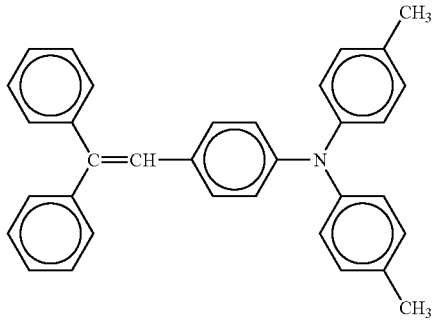

(72)

| | |
|---|---|
| Tetrahydrofuran | 100 |

Figure 14:
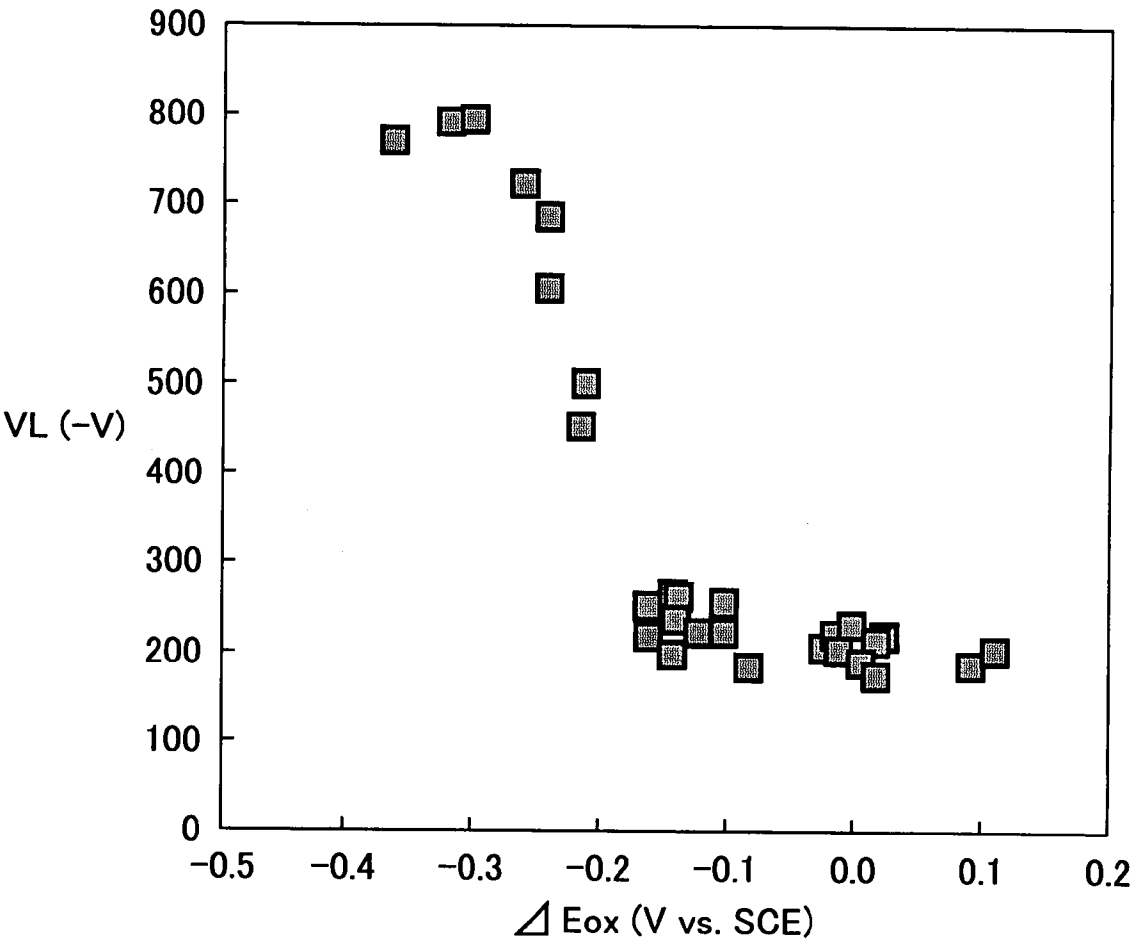
FIG. 14 is a chart showing a relationship between a difference (Δ E) between the oxidation potential of the compound having an alkylamino group and that of a fourth CTM, and a bright section potential (VL) in the electrophotographic photoreceptor of the present invention.

Further, a protection layer having a thickness of about 4 μm is formed on the CTL by spraying a protection layer coating liquid having the following formulation onto the CTL to prepare photoreceptors 103 to 136. The evaluation results of the photoreceptors are shown in Table 4 and FIG. 14.

| Protection layer coating liquid | |
|---|---|
| Alumina having an average primary particle diameter of 0.3 μm from Sumitomo Chemical Co., Ltd. | 2 |
| The compounds having an alkylamino group No. 1 to 34 | 0.5 |
| Unsaturated polycarbonate polymer solution having an acid value of 180 mg KOH/g from BYK Chemie GmbH | 0.02 |
| CTM having the following formula (73) and an oxidation potential of 0.76 (V vs. SCE) | 3.5 |

-continued

Protection layer coating liquid

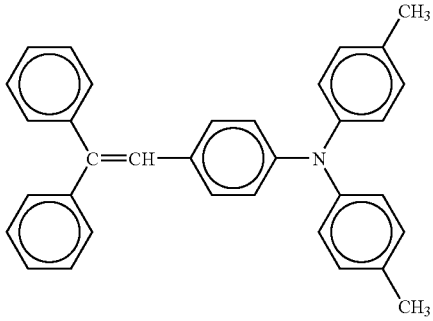

(73)

| | |
|---|---|
| Polycarbonate resin (Z polyca from Teijin Chemicals Ltd.) | 6 |
| Tetrahydrofuran | 220 |
| Cyclohexanone | 80 |

TABLE 4

| | No. of compound | ΔE (V vs. SCE) | VL (−V) | Initial Image quality | After 100,000 Image quality |
|---|---|---|---|---|---|
| Com. Ex. 20 | 1 | −0.240 | 600 | Image was not produced | — |
| Com. Ex. 21 | 2 | −0.155 | 237 | Good | Good |
| Com. Ex. 22 | 3 | −0.260 | 720 | Image was not produced | — |
| Com. Ex. 23 | 4 | −0.320 | 787 | Image was not produced | — |
| Ex. 84 | 5 | −0.105 | 221 | Good | Good |
| Com. Ex. 24 | 6 | −0.240 | 682 | Image was not produced | — |
| Ex. 85 | 7 | −0.210 | 496 | Low image density | Low image density |
| Ex. 86 | 8 | −0.110 | 220 | Good | Good |
| Ex. 87 | 9 | −0.120 | 221 | Good | Good |

TABLE 4-continued

| | No. of compound | ΔE (V vs. SCE) | Initial VL (−V) | Initial Image quality | After 100,000 Image quality |
|---|---|---|---|---|---|
| | 10 | −0.100 | 221 | | |
| Ex. 88 | | | | Good | Good |
| | 11 | −0.100 | 222 | | |
| Ex. 89 | | | | Good | Good |
| | 12 | −0.135 | 262 | | |
| Ex. 90 | | | | Good | Good |
| | 13 | 0.115 | 202 | | |
| Ex. 91 | | | | Good | Good |
| | 14 | −0.100 | 252 | | |
| Ex. 92 | | | | Good | Good |
| | 15 | 0.020 | 211 | | |
| Ex. 93 | | | | Good | Good |
| | 16 | −0.010 | 218 | | |
| Ex. 94 | | | | Good | Good |
| | 17 | −0.160 | 248 | | |
| Ex. 95 | | | | Good | Good |
| | 18 | −0.135 | 235 | | |
| Ex. 96 | | | | Good | Good |
| | 19 | −0.365 | 765 | | |
| Com. Ex. 25 | | | | Image was not produced | — |
| | 20 | −0.100 | 255 | | |
| Ex. 97 | | | | Good | Good |
| | 21 | −0.140 | 265 | | |
| Ex. 98 | | | | Good | Good |
| | 22 | −0.215 | 448 | | |
| Com. Ex. 26 | | | | Good | Low image density |
| | 23 | 0.000 | 227 | | |
| Ex. 99 | | | | Good | Good |
| | 24 | −0.300 | 789 | | |
| Com. Ex. 27 | | | | Image was not produced | — |
| | 25 | 0.025 | 216 | | |
| Ex. 100 | | | | Good | Good |
| | 26 | −0.020 | 203 | | |
| Ex. 101 | | | | Good | Good |
| | 27 | −0.010 | 199 | | |
| Ex. 102 | | | | Good | Good |
| | 28 | −0.160 | 216 | | |
| Ex. 103 | | | | Good | Good |
| | 29 | 0.095 | 184 | | |
| Ex. 104 | | | | Good | Good |
| | 30 | −0.080 | 184 | | |
| Ex. 105 | | | | Good | Good |
| | 31 | −0.140 | 198 | | |
| Ex. 106 | | | | Good | Good |
| | 32 | −0.010 | 204 | | |
| Ex. 107 | | | | Good | Good |
| | 33 | 0.020 | 174 | | |
| Ex. 108 | | | | Good | Good |
| | 34 | 0.010 | 187 | | |
| Ex. 109 | | | | Good | Good |

Comparative Example 28

The procedures for preparation and evaluation of the photoreceptor in Example 1 were repeated to prepare and evaluate a comparative photoreceptors 1 except for not adding the compound having an alkylamino group into the CTL coating liquid. The results are shown in Table 5.

Comparative Example 29

The procedures for preparation and evaluation of the photoreceptor in Example 1 were repeated to prepare and evaluate a comparative photoreceptors 2 except for changing the compound having an alkylamino group into a hindered phenol antioxidant having the following formula (74). The results are shown in Table 5.

TABLE 5

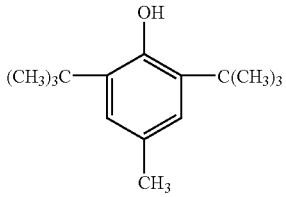

(74)

| | Comparative Photoreceptor No. | Initial VL (-V) | Initial Image quality | After 100,000 Image quality |
|---|---|---|---|---|
| Com. Ex. 28 | 1 | 100 | Good | Image resolution lowered (moderate) |
| Com. Ex. 29 | 2 | 545 | Low image density | Image density lowered (large) and illegible |

The results show that an electrophotographic photoreceptor including an electroconductive substrate and a photosensitive layer on the electroconductive substrate, wherein the photosensitive layer includes at least a compound having a substituted or unsubstituted alkylamino group and a charge transport material, and wherein an oxidation potential (Eox1) of the substituted or unsubstituted alkylamino group and an oxidation potential (Eox2) of the charge transport material satisfy the following relationship (I) has a high sensitivity and stably produces high-quality images even after 100,000 images are produced.

$$Eox1-Eox2 \geqq -0.2 \quad (I)$$

On the other hand, when out of the above-mentioned relationship, the bright portion of the resultant photoreceptor is extremely high from the beginning. Therefore, the image density deteriorates and no image can be produced.

The deterioration of image resolution of the images produced by the comparative photoreceptor 1 in Comparative Example 28 due to repeated use is worse than that of the images produced by the photoreceptor of the present invention because of not including the compound having an alkylamino group effective for oxidizing gases causing blurred images.

Further, the comparative photoreceptor 2 in Comparative Example 29 including only a typical antioxidant in its CTL has a high bright portion potential from the beginning and does not produce good images.

This document claims priority and contains subject matter related to Japanese Patent Application No. 2003-049975 filed on Feb. 26, 2003 incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An electrophotographic photoreceptor comprising:

an electroconductive substrate; and a photosensitive layer overlying the electroconductive substrate, wherein the photosensitive layer comprises a compound having a substituted or unsubstituted alkylamino group and a charge transport material, and wherein an oxidation potential (Eox1) of the substituted or unsubstituted alkylamino group and an oxidation potential (Eox2) of the charge transport material satisfy the following relationship (I):

$$Eox1-Eox2 \geqq -0.2 \quad \text{(I).}$$

2. The electrophotographic photoreceptor of claim 1, wherein the charge transport material is a stilbene compound having the following formula (1):

(1)

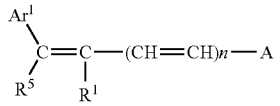

wherein n is 0 or 1; $R^1$ represents a hydrogen atom, an alkyl group or a substituted or unsubstituted phenyl group; $Ar^1$ represents a substituted or unsubstituted aryl group; $R^5$ represents an alkyl group having 1 to 4 carbon atoms or a substituted or unsubstituted aryl group; and A represents a 9-anthryl group, a substituted or unsubstituted carbazolyl group or a group having the following formula (4) or (5):

(4)

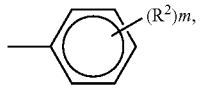

(5)

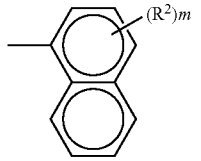

wherein $R^2$ represents a hydrogen atom, an alkyl group, an alkoxy group, a halogen atom or a group having the following formula (6); and m is an integer of from 1 to 3;

(6)

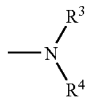

wherein $R^3$ and $R^4$ independently represent a substituted or unsubstituted aromatic ring group, and optionally form a ring, and wherein $R^2$ is optionally the same or different from each other when m is not less than 2, and A and $R^1$ optionally form a ring together when n is 0.

3. The electrophotographic photoreceptor of claim 1, wherein the charge transport material is a hydrazone compound having the following formula (2):

(2)

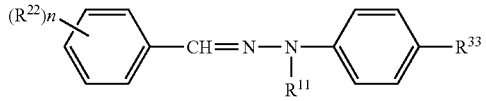

wherein the $R^{11}$ represents an alkyl group, a benzyl group, a phenyl group or a naphtyl group; $R^{22}$ represents a hydrogen atom, an alkyl group having 1 to 3 carbon atoms, an alkoxy group having 1 to 3 carbon atoms, a dialkylamino group, a diaralkylamino group or a substituted or unsubstituted diarylamino group; n represents integers of from 1 to 4 and $R^{22}$ is optionally the same or different from each other when n is not less than 2; and $R^{33}$ represents a hydrogen atom or a methoxy group.

4. The electrophotographic photoreceptor of claim 1, wherein the charge transport material is a charge transport polymer material having the following formula (3):

(3)

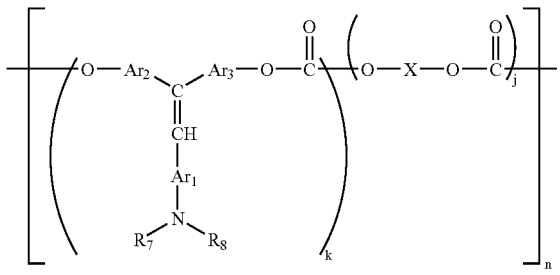

wherein $R^7$ and $R^8$ independently represent a substituted or unsubstituted aromatic ring group; $Ar^1$, $Ar^2$ and $Ar^3$ independently represent an aromatic ring group; k is a number of from 0.1 to 1.0 and j is a number of from 0 to 0.9; n represents a repeating number and is an integer of from 5 to 5,000; and X represents a divalent aliphatic group, a divalent alicyclic group or a divalent group having the following formula (7):

(7)

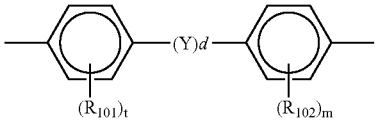

wherein, $R^{101}$ and $R^{102}$ independently represent a substituted or unsubstituted alkyl group, a substituted or unsubstituted aryl group, or a halogen atom; t and m independently represent 0 or an integer of from 1 to 4; d is 0 or 1; and Y represents a linear alkylene group, a branched alkylene group, a cyclic alkylene group, —O—, —S—, —SO—, —$SO_2$—, —CO—, —CO—O—Z—O—CO— (Z represents a divalent aliphatic group), or a group having the following formula (8):

(8)

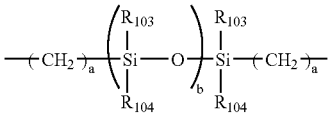

wherein, a is an integer of from 1 to 20; b is an integer of from 1 to 2,000; and $R^{103}$ and $R^{104}$ independently represent a substituted or unsubstituted alkyl group, or a substituted or unsubstituted aryl group, and wherein $R^{101}$, $R^{102}$, $R^{103}$ and $R^{104}$ are optionally the same or different from one another.

5. The electrophotographic photoreceptor of claim 1, further comprising a protection layer comprising a filler overlying the photosensitive layer.

6. An image forming method comprising:

charging the electrophotographic photoreceptor according to claim 1;

irradiating the electrophotographic photoreceptor with light to form an electrostatic latent image thereon;

developing the electrostatic latent image with a developer comprising a toner to form a toner image on the electrophotographic photoreceptor; and transferring the toner image onto a transfer sheet.

7. The image forming method of claim 6, wherein the light irradiating is performed by using a laser diode or a light emitting diode.

8. An image forming apparatus comprising:

the electrophotographic photoreceptor according to claim 1;

a charger configured to charge the electrophotographic photoreceptor;

an irradiator configured to irradiate the electrophotographic photoreceptor with light to form an electrostatic latent image thereon;

an image developer configured to develop the electrostatic latent image with a developer comprising a toner to form a toner image on the electrophotographic photoreceptor; and a transferer configured to transfer the toner image onto a transfer sheet.

9. The image forming apparatus of claim 8, wherein the the irradiator comprises a laser diode or a light emitting diode.

10. A process cartridge comprising:

the electrophotographic photoreceptor according to claim 1; and at least one member selected from the group consisting of chargers, irradiators, image developers, transferers, cleaners and dischargers.

* * * * *